US007666085B2

(12) United States Patent
Vorias et al.

(10) Patent No.: US 7,666,085 B2
(45) Date of Patent: Feb. 23, 2010

(54) GAMING DEVICE WHICH DISPLAYS MULTIPLE GAMING RESULTS WHEREIN SUBSEQUENT RESULTS ARE FORMED FROM PREVIOUS RESULTS

(75) Inventors: William E. Vorias, Las Vegas, NV (US); Anthony J. Baerlocher, Reno, NV (US); Daniel W. Sopala, Henderson, NV (US); Matthew Earl Belger, N. Las Vegas, NV (US)

(73) Assignee: IGT, Reno, NV (US)

( * ) Notice: Subject to any disclaimer, the term of this patent is extended or adjusted under 35 U.S.C. 154(b) by 944 days.

(21) Appl. No.: 10/241,128

(22) Filed: Sep. 11, 2002

(65) Prior Publication Data

US 2004/0048651 A1 Mar. 11, 2004

(51) Int. Cl.
*A63F 9/24* (2006.01)

(52) U.S. Cl. ..... 463/20; 463/16; 463/17; 463/19; 463/21

(58) Field of Classification Search ..... 463/16–21
See application file for complete search history.

(56) References Cited

U.S. PATENT DOCUMENTS 4,826,169 A 5/1989 Bessho et al.
5,584,764 A 12/1996 Inoue
5,609,524 A 3/1997 Inoue
5,647,798 A 7/1997 Falciglia
5,704,835 A * 1/1998 Dietz, II ..... 463/20
5,823,873 A 10/1998 Moody
5,833,537 A * 11/1998 Barrie ..... 463/21
5,919,088 A 7/1999 Weiss
5,935,002 A 8/1999 Falciglia
5,947,820 A 9/1999 Morro et al.
5,980,384 A * 11/1999 Barrie ..... 463/16
5,984,782 A 11/1999 Inoue
6,159,095 A 12/2000 Frohm et al.
6,220,959 B1 * 4/2001 Holmes et al. ..... 463/13
6,251,013 B1 * 6/2001 Bennett ..... 463/13
6,315,663 B1 11/2001 Sakamoto (Continued)

FOREIGN PATENT DOCUMENTS

DE 31 05 266 A1 9/1982

(Continued)

OTHER PUBLICATIONS

Barn Yard Advertisement written by Aristocrat, not dated.

(Continued)

*Primary Examiner*—James S. McClellan
*Assistant Examiner*—Sunit Pandya
(74) *Attorney, Agent, or Firm*—K & L Gates LLP

(57) ABSTRACT

A gaming device which displays multiple results wherein subsequently displayed results are formed from previously displayed results. A gaming device randomly generates and displays a first set of symbols. The gaming device also generates a second set of symbols. The second set of symbols are not initially displayed to a player. The gaming device compares the first and second set of symbols to determine whether any symbols in the first set of symbols match any symbols in the second set of symbols. The gaming device displays the matching symbols and then displays the second set of symbols.

18 Claims, 20 Drawing Sheets

U.S. PATENT DOCUMENTS

| | | | | |
|---|---|---|---|---|
| 6,331,143 | B1 | 12/2001 | Yoseloff | |
| 6,347,996 | B1 | 2/2002 | Gilmore et al. | |
| 6,439,993 | B1 | 8/2002 | O'Halloran | |
| 6,439,995 | B1 | 8/2002 | Hughs-Baird et al. | |
| 6,589,114 | B2 | 7/2003 | Rose | |
| 6,652,378 | B2 | 11/2003 | Cannon et al. | |
| 6,656,040 | B1 | 12/2003 | Brosnan et al. | |
| 6,676,512 | B2 | 1/2004 | Fong et al. | |
| 6,910,962 | B2 | 6/2005 | Marks et al. | |
| 6,960,133 | B1 | 11/2005 | Marks et al. | |
| 7,070,502 | B1 | 7/2006 | Bussick et al. | |
| 7,144,322 | B2 * | 12/2006 | Gomez et al. | 463/20 |
| 2003/0017867 | A1 * | 1/2003 | deKeller | 463/18 |
| 2003/0064785 | A1 | 4/2003 | Stone et al. | |
| 2003/0069064 | A1 | 4/2003 | Ainsworth | |
| 2004/0029631 | A1 | 2/2004 | Duhamel | |
| 2005/0148381 | A1 | 7/2005 | Marks et al. | |
| 2005/0282620 | A1 | 12/2005 | Marks et al. | |
| 2005/0288094 | A1 | 12/2005 | Marks et al. | |
| 2006/0172795 | A1 | 8/2006 | Bussick et al. | |

FOREIGN PATENT DOCUMENTS

| | | | |
|---|---|---|---|
| EP | 1 184 822 | | 3/2002 |
| GB | 2 106 292 | A | 8/1981 |
| GB | 2 090 690 | A | 7/1982 |
| GB | 2 0 96 376 | A | 10/1982 |
| GB | 2 097 160 | A | 10/1982 |
| GB | 2 100 905 | A | 1/1983 |
| GB | 2 105 891 | A | 3/1983 |
| GB | 2 117 155 | A | 10/1983 |
| GB | 2 137 392 | A | 10/1984 |
| GB | 2 161 008 | A | 1/1986 |
| GB | 2 170 643 | A | 8/1986 |
| GB | 2 181 589 | A | 4/1987 |
| GB | 2 183 882 | A | 6/1987 |
| GB | 2 191 030 | A | 12/1987 |
| GB | 2 222 712 | A | 3/1990 |
| GB | 2 225 889 | A | 6/1990 |
| GB | 2 226 436 | A | 6/1990 |
| GB | 2 242 300 | A | 9/1991 |
| GB | 2 262 642 | A | 6/1993 |
| WO | WO0032286 | | 6/2000 |

OTHER PUBLICATIONS

Barn Yard Article in Strictly Slots, published in Mar. 2002.
Gold Fever Advertisement written by Atronic Casino Technology, Ltd., published 1999.
Gold Fever Atronic Web Page written by Atronic Casino Technology, Ltd., dated Mar. 2002.
Jewel in the Crown Advertisements written by Barcrest Ltd., published 1999.

* cited by examiner

GAMING DEVICE WHICH DISPLAYS MULTIPLE GAMING RESULTS WHEREIN SUBSEQUENT RESULTS ARE FORMED FROM PREVIOUS RESULTS

CROSS-REFERENCE TO RELATED APPLICATIONS

This application is related to the following commonly-owned co-pending patent applications: "GAMING DEVICE HAVING DUAL EVALUATION SCHEME," Ser. No. 09/687,689.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device which displays multiple gaming results wherein subsequent results are formed from previous results.

BACKGROUND OF THE INVENTION

Gaming machines and specifically slot machines currently exist with mechanical or video reels having symbols thereon. In general, a player is awarded one or more credits in a slot gaming machine when one or more randomly generated symbols or combination of symbols appear on a payline. Known gaming devices also award credits for combinations of scattered symbols.

To increase player enjoyment and excitement provided by gaming machines, gaming device manufacturers constantly strive to provide players with new types of gaming machines that attract players and keep players entertained. One proven way manufacturers use to make their gaming machines more popular is to increase the number and variety of winning combinations and provide more opportunities for the player to win. Providing more variety and opportunities holds the player's interest for a longer time and also enables the manufacturer to have a wider range of payouts for the winning combinations.

To increase the number and variety of winning combinations, manufacturers have increased the number of paylines, the number of symbol positions or paystops and the number of gaming reels.

Paylines are generally predetermined arrays or reel stop positions of the set of reels where the gaming machine evaluates whether a predetermined combination of symbols occurred. A payline may consist of any number or configurations of positions of gaming symbols. For example, a payline for a set of reels can consist of a horizontal line of gaming symbols along the reels, or a diagonal line of gaming symbols along the reels, or a line overlapping several rows along the reels. It is well known to provide gaming machines with multiple paylines. With the increased complexity of the number and the positioning of the paylines on a singular set of reels, it becomes increasingly unwieldy for the gaming software to evaluate a winning combination or combinations of gaming symbols. At some point, adding variety yields diminished returns because of increased complexity. Multiple winning combinations may also become too complex for the player (i.e., a player may win after a given spin of the reels and find it difficult to determine how, where or why the player has won).

Gaming manufacturers have also increased the number of symbol positions or paystops. Increasing the number of paystops increases the number of different symbols a game can have and increases the number of times a particular symbol can appear. One way manufacturers have increased the number of paystops has been to increase the size of the reel to accommodate more stops. Original gaming machines had approximately ten stops per reel, modern mechanical reels have approximately thirty to thirty-five stops per reel and modern video machines have no technical physical limit. Increasing the number of times that a symbol can appear increases its likelihood of appearance, which affects the payout of a winning combination containing that symbol.

Another way manufacturers have increased the number of paystops has been to add reels. Many current slot machines display a set of five reels with three gaming symbols visible on each reel. This results in a visible set of gaming symbols in a three by five configuration. Slot machines may also utilize more than five reels and/or more than three visible gaming symbols on each reel, such as a ten reel configuration with ten visible gaming symbols on each reel. Such a slot machine may have a large number of potential paylines on a singular set of reels. As with increasing the paylines, the additional reels increases the complexity of the slot machine and eventually the slot machine becomes too unwieldy for the player and/or its software. For example, video reel machines have not increased the number of reels above five mainly because five reels created enough diversity to keep the game interesting without becoming too complex for the player to enjoy.

Current gaming machines also provide secondary or bonus games in addition to primary games. These secondary or bonus games are generally different from the primary game. The secondary or bonus games are generally played separately from the primary game. For instance, secondary or bonus games may be evaluated with a different set of predetermined combinations of the gaming symbols and/or different paylines. Bonus games may also be completely different games.

It should accordingly be appreciated that gaming machines have become rather complex in comparison to the original three reel, ten stop machine created before 1900. At some point, adding variety yields diminished returns as the inevitable accompanying complexity of placing multiple bets and trying to keep tract of multiple winning combinations for each bet becomes too complex for the player. A player may win after a given spin of the reels and find it difficult to determine how, where or why the player has won. Mechanical reels, which are limited in drum radius, have limited space with which to display the multitude of symbols. Simulated reel displays are also limited in size to make room for other input devices and displays requiring panel space. The limited display space and viewing area furthers the complexity created by the multitude of paylines and winning combinations.

Therefore, a need exists to create new and exciting games which increase the player's enjoyment and excitement. It is desirable to provide new gaming machines wherein a player has the opportunity to increase the number and variety of winning combinations and provide more opportunities for the player to win. It is also desirable to provide new gaming machines with new games whereby players can easily recognize winning combinations of gaming symbols, how those symbols were generated, and how and where the player won.

SUMMARY OF THE INVENTION

The present invention involves a gaming device having multiple results where a subsequent displayed result is formed from a previously displayed result. The gaming device of one embodiment of the present invention includes a plurality of video gaming reels. The video gaming reels are stored in the memory of the gaming device and controlled by the processor of the gaming device. The processor also controls the display device of the gaming device and selectively causes the display device to display the reels and the spinning of the video reels or the random generation of the reel symbols and the ultimate result in a conventional manner. In one embodiment of the present invention, the processor generates and causes the display device to display a first set of symbols randomly generated on the plurality of video gaming reels. The processor then randomly generates a second set of symbols on the plurality of video gaming reels. The processor does not cause the display device to display this second generation of the reels or the second set of symbols. For purposes of this application, this second random generation of the video reels is referred herein as the virtual generation of the reels or the virtual set of symbols because the generation occurs without initially displaying such generation to the player. The processor compares the first set of symbols and the virtual or second set of symbols for matching symbols. The processor causes the display device to display the symbols which match in the first and second set of symbols, and then displays the second set of symbols which include the matching symbols. In this manner, the gaming device displays multiple results wherein a subsequent displayed result appears to be formed from the previously displayed result.

In a preferred embodiment of the present invention, the processor causes at least one display device to display of a first set of symbols. The processor then causes at least one matching symbol from the first set of symbols to continue to be displayed and causes the other symbols from the first set of symbols to simultaneously or sequentially disappear from the display. The processor causes the matching symbol or symbols to be incorporated or merged into a second set of symbols. The processor finally causes the complete second set of symbols to be displayed. The present invention creates a sense of anticipation as the player awaits another set of symbols to be formed in which the player has an opportunity to win an award.

The present invention also provides the player with a number of opportunities to win an award not found in other gaming devices. In one embodiment of the present invention, the player may win or be provided with at least one award for at least one winning combination of symbols which is included in the first set of symbols. In another embodiment, the player may be provided with at least one award for at least one winning combination of symbols which is included in the second set of symbols. The winning combinations of symbols may include a predetermined combination of symbols occurring in certain positions or paylines on the display or gaming reels. The winning combinations of symbols preferably include multiple paylines.

It should be appreciated that in an embodiment of the present invention which includes multiple paylines associated with the winning combination of symbols may also include the processor enabling a player to select and wager on one or more of the paylines.

In one embodiment of the present invention, the processor provides the player with awards for winning combinations of symbols occurring in both the first and second set of symbols.

In another embodiment of the present invention, the processor compares the symbols generated by each video gaming reel in the first and second sets of symbols. For example, in an embodiment which includes five video gaming reels, each of the five reels displays three symbols and the first set of symbols displayed is a three by five configuration. The second set of virtually generated symbols is also a three by five configuration. The processor will compare the three symbols in the first and second set of symbols generated by the first video gaming reel, then the symbols generated by the second video gaming reel, then the symbols generated by the third video gaming reel, then the symbols generated by the fourth video gaming reel, and, finally, the symbols generated by fifth video gaming reel. In this embodiment, when the matching symbols are displayed, only the matching symbols associated with each video gaming reel will be shown. In one embodiment of the present invention, the processor provides the player with an award if there is a matching symbol displayed on each of the displayed gaming reels.

In one embodiment of the present invention, the processor causes the display device to display a plurality of video gaming reels which randomly generate a first set of symbols. The processor causes the video gaming reels to randomly generate a second set of symbols. The processor does not cause the random generation of the second set of symbols or the second set of symbols to be displayed. The processor determines whether at least one symbol in the first set of symbols matches at least one symbol in the second set of symbols. The processor causes the display device to display the matching symbols, adds new symbols to replace the non-matching symbols and provides an award to the player if the matching symbols include at least one winning combination. The new symbols are preferably the symbols from the second set. In certain embodiments, the processor causes the display device to shift the matching symbols into new positions or rearranges the symbols.

The processor may also compare the symbols generated by each position on each video gaming reel to determine if the symbols in each position match. In such case, the processor would keep the matching symbols displayed. It should also be appreciated that the gaming device can include more than one set of symbols.

In one embodiment of the present invention, the processor causes the video gaming reels to randomly generate and display a first set of symbols. The processor also causes the video gaming reels to generate multiple virtual sets of symbols. The processor does not cause the random generation of the multiple virtual sets of symbols or the multiple virtual sets of symbols to be displayed. The processor causes the selection of at least one of the virtual sets of symbols. The gaming device determines if any of the symbols in the first set of symbols match any of the symbols in the selected virtual set of symbols. If there are matching symbols, the processor causes the display device to display the matching symbols. The processor then causes the display device to display the remaining selected virtual set of symbols, and provides the player with at least one award if the selected virtual set of symbols includes at least one winning combination of symbols. It should be understood that the virtual set of symbols may either be selected by the processor or by the player.

It should be appreciated that the gaming device can include more than one plurality of video gaming reels which are displayed by one or more display devices.

In one embodiment of the present invention, the gaming device displays more than one plurality of video gaming reels. The processor causes the multiple pluralities of video gaming reels to each randomly generate and display a set of symbols. The processor causes a selection of at least one displayed set of symbols. The processor causes at least one of the video gaming reels to randomly generate a virtual set of symbols. The processor does not cause the random generation of the virtual set of symbols or the virtual set of symbols to be displayed. The processor determines if any of the symbols in the selected set of symbols match any of the symbols in the virtual set of symbols. If there are any matching symbols, the processor causes the display of the matching symbols. The processor then causes the display of the virtual set of symbols including the matching symbols, and awards the player with at least one award if the virtual set of symbols includes at least one winning combination of symbols.

In a further alternative embodiment of the present invention, the processor selects a predetermined or randomly determined number of symbols to save from the first randomly generated set of symbols. These symbols are not displayed to the player. It should be appreciated that the random selection could be based on a variety of different determinations. In one embodiment, each symbol has a probability of being saved and the processor determines whether each symbol is saved based on the probability associated with that symbol. In an alternative embodiment, certain locations or positions where the symbols are determined to be are saved. In this embodiment, the second set of symbols is generated based on the saved symbols from the first set. The processor then randomly generates new or additional symbols in addition to the symbols which are saved. The processor can cause the display of the originally saved symbols and the additional symbols in any suitable manner. In one embodiment, the gaming device displays the first set of symbols, removes the non-saved symbols while continuing to display the saved symbols, and then displays the additional symbols. In an alternative embodiment, the processor displays one or move of the saved symbols shifting on the reel(s) to other locations such as along the bottom row.

It should also be appreciated that the method of determining the virtual set of symbols and using those symbols to determine matches could be repeated a plurality of times. It should also be appreciated that the other embodiments of the method of the present invention can be repeated a plurality of times.

Additional features and advantages of the present invention are described in, and will be apparent from, the following Detailed Description of the Invention and the figures.

DETAILED DESCRIPTION OF THE INVENTION

Gaming Device and Electronics

Figure 1A:
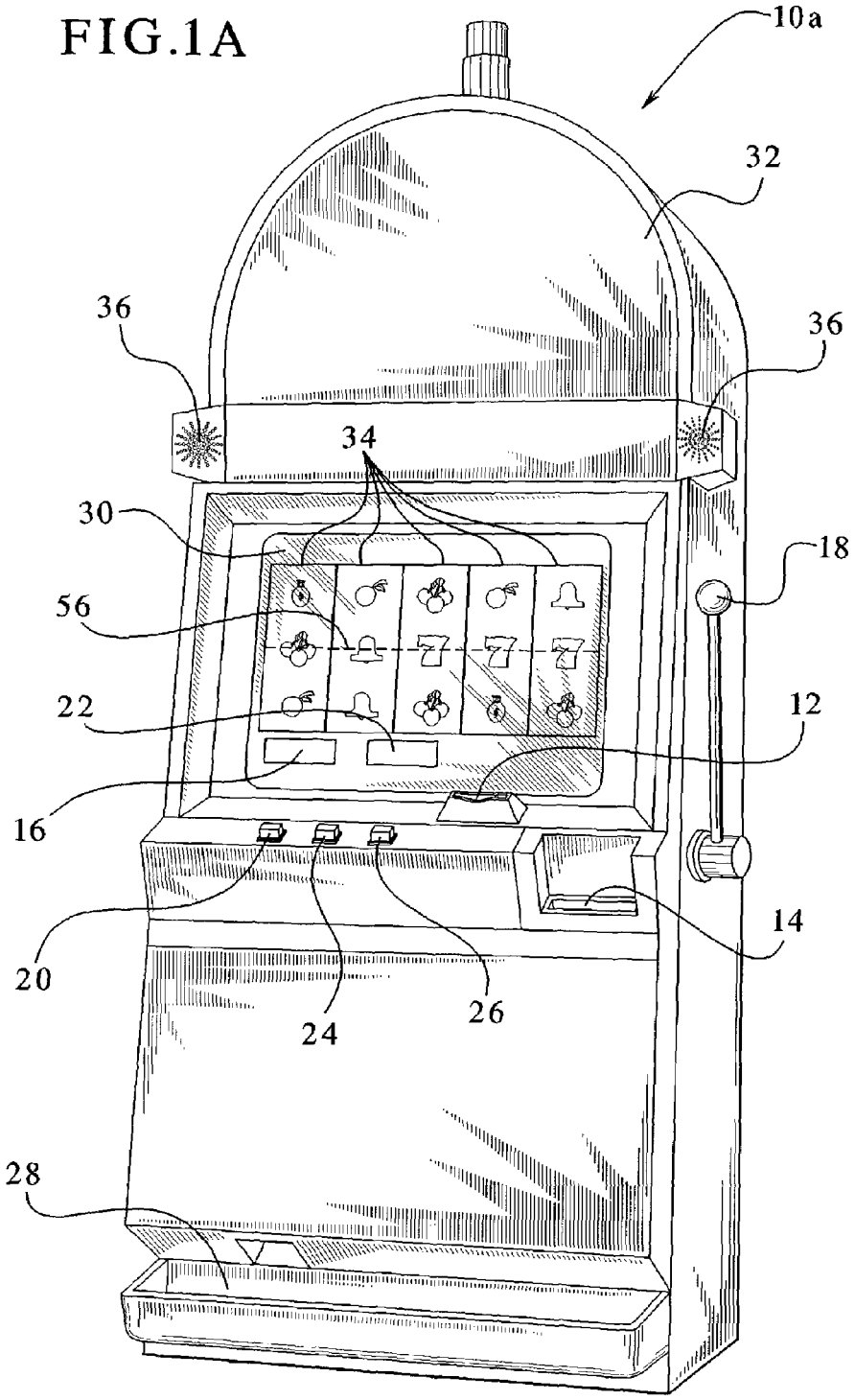
FIG. 1A is a front perspective view of one embodiment of the gaming device of the present invention.
Figure 1B:
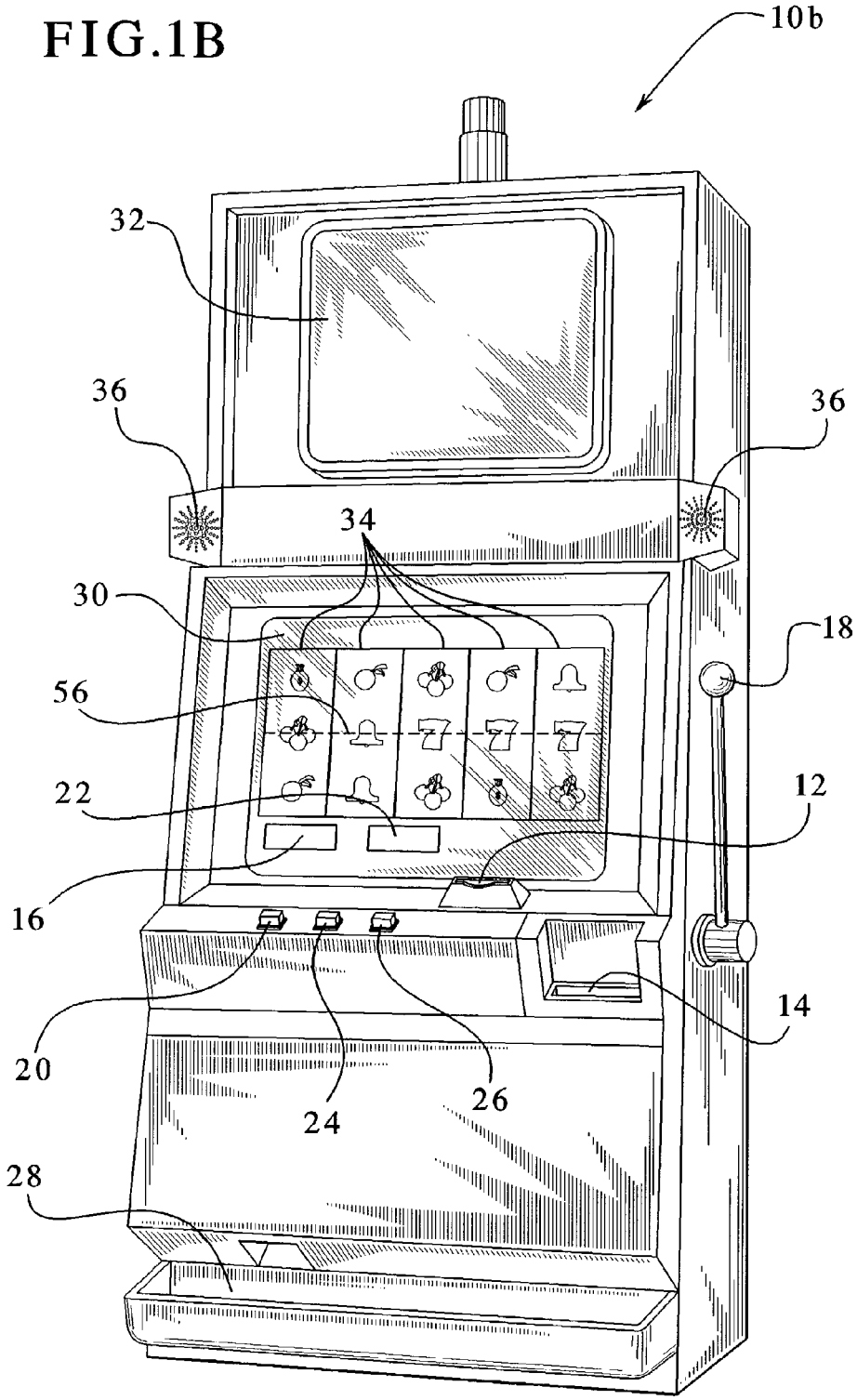
FIG. 1B is a front perspective view of one embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is in one embodiment a slot machine having the controls, displays and features of a conventional slot machine. It is constructed so that a player can operate it while standing or sitting, and gaming device 10 is preferably mounted on a console or cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno, any of the bonus triggering events and any of the bonus round games related thereto. The symbols and indicia used on and in gaming device 10 may be in mechanical, electronic, electrical or video form.

As illustrated in FIGS. 1A and 1B, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

A player may cash out and thereby receive a number of coins corresponding to the number of remaining credits by pushing a cash out button 26. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. A display device can be any viewing surface such as glass, a video monitor or screen, a liquid crystal display or any other display mechanism.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
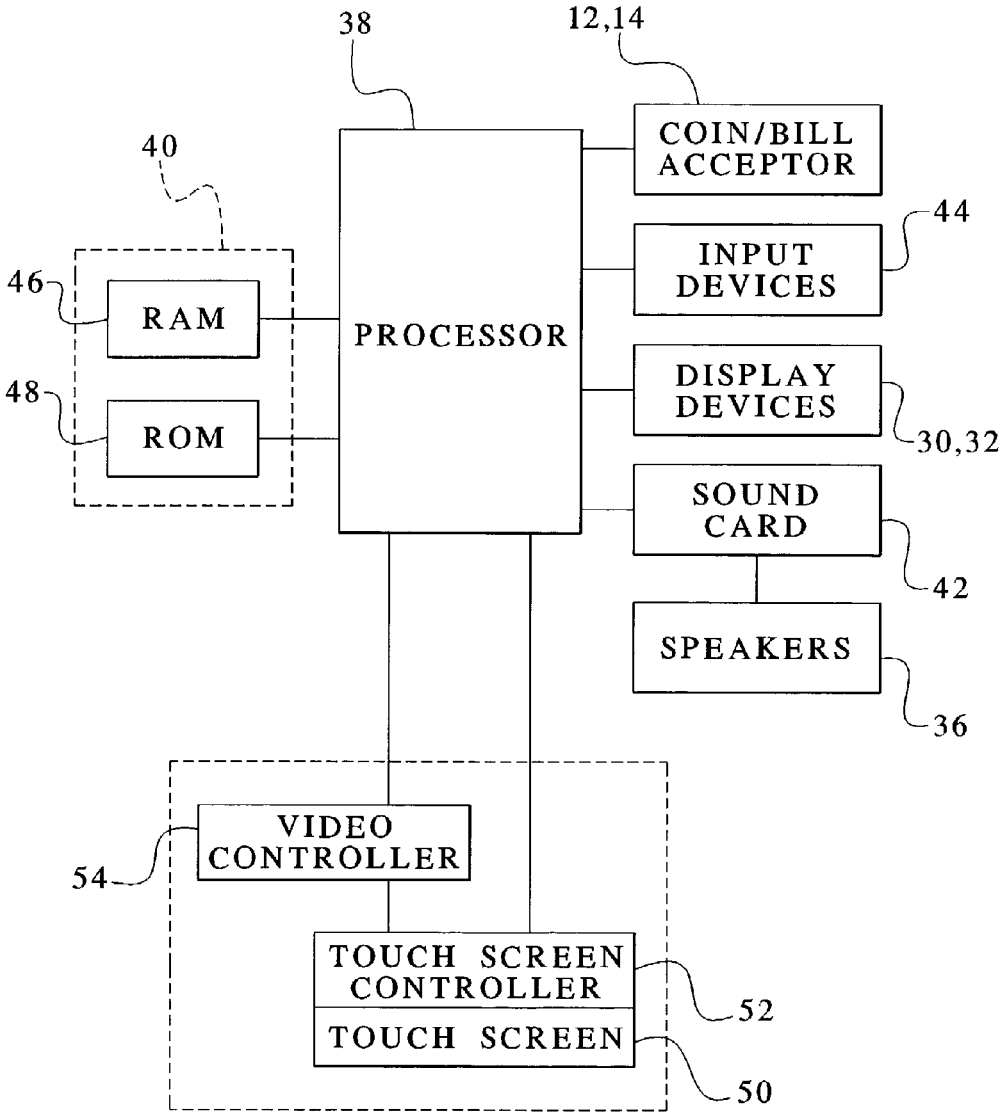
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively and/or individually referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the computer or controller.

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines displayed in a horizontal and/or diagonal fashion.

Forming Subsequent Results from Previous Results

Figure 3:
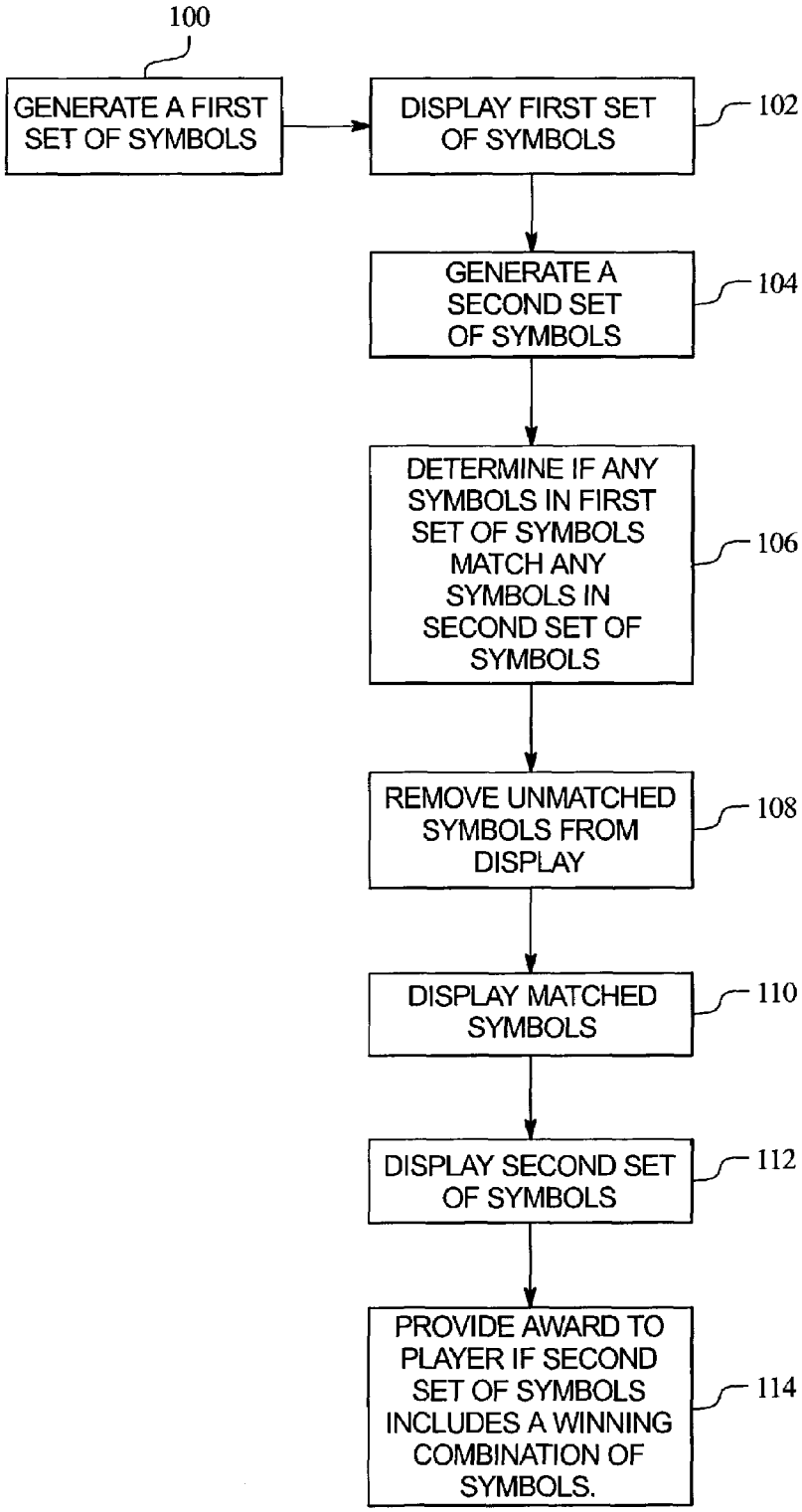
FIG. 3 is a flow diagram of one embodiment of the present invention.

The present invention is directed to a method for and a gaming device which displays multiple results, wherein subsequent displayed results are formed from previously displayed results. One general embodiment of the present invention is illustrated in FIG. 3. The processor 38 causes the random generation of a first set of symbols as illustrated by block 100. The processor 38 causes the display of the first set of symbols as shown by block 102. The processor 38 causes the random generation of a second set of symbols as illustrated by block 104. Neither the random generation of the second set of symbols nor the second set of symbols is displayed to the player. The processor 38 determines if any symbols in the first set of symbols match any symbols in the second set of symbols as illustrated by block 106. The processor 38 simultaneously or sequentially removes any unmatched symbols from the display as illustrated by block 108. The processor 38 causes the display of the matched symbols as illustrated by block 110 and then causes the display of the second set of symbols as shown by block 112. In this embodiment, the processor 38 provides an award to the player if the second set of symbols includes a winning combination of symbols as illustrated by block 114.

Figure 4:
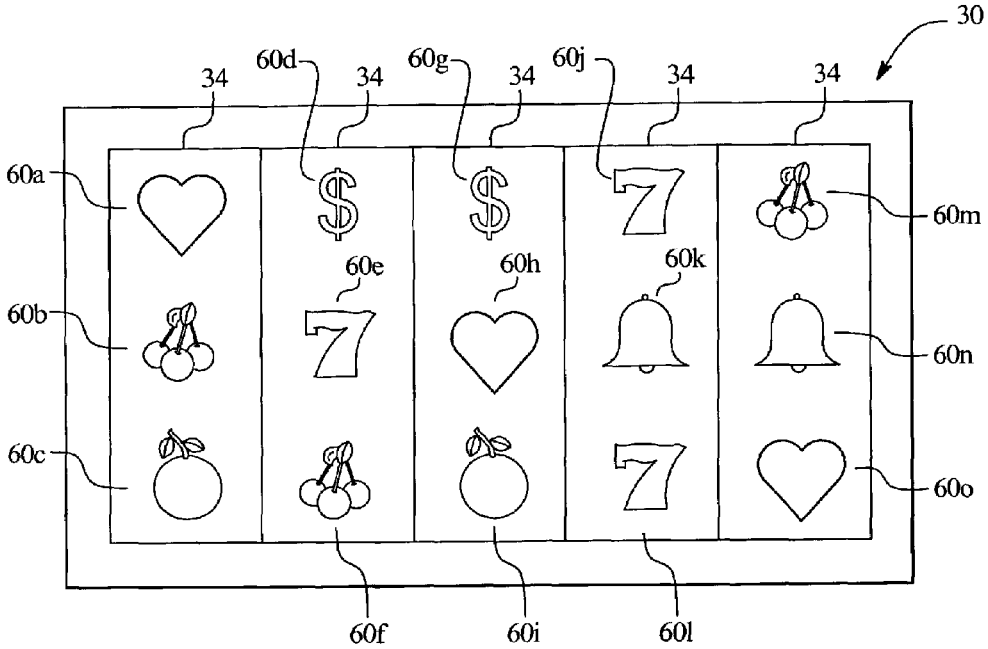
FIG. 4 is an enlarged front elevation view of one of the display devices of FIGS. 1A and 1B illustrating one embodiment of the present invention, wherein a set of symbols is initially displayed.
Figure 5:
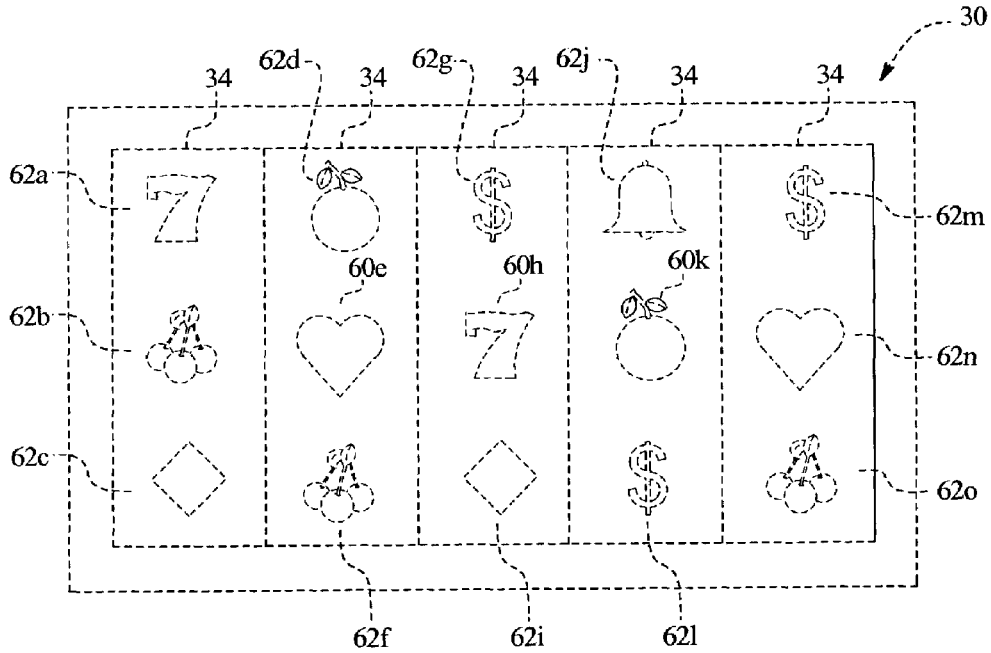
FIG. 5 is a view of one embodiment of the present invention, wherein a virtual set of symbols is generated by the gaming device.
Figure 6A:
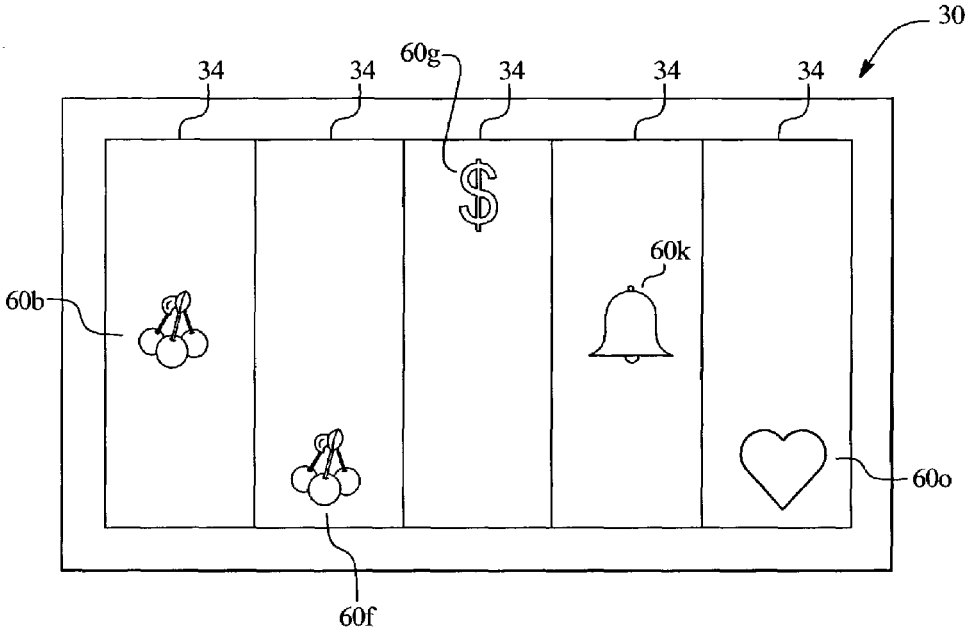
FIGS. 6A and 6B are enlarged front elevation views of one of the display devices of FIGS. 1A and 1B illustrating one embodiment of the present invention, wherein the matching symbols are displayed.
Figure 6B:
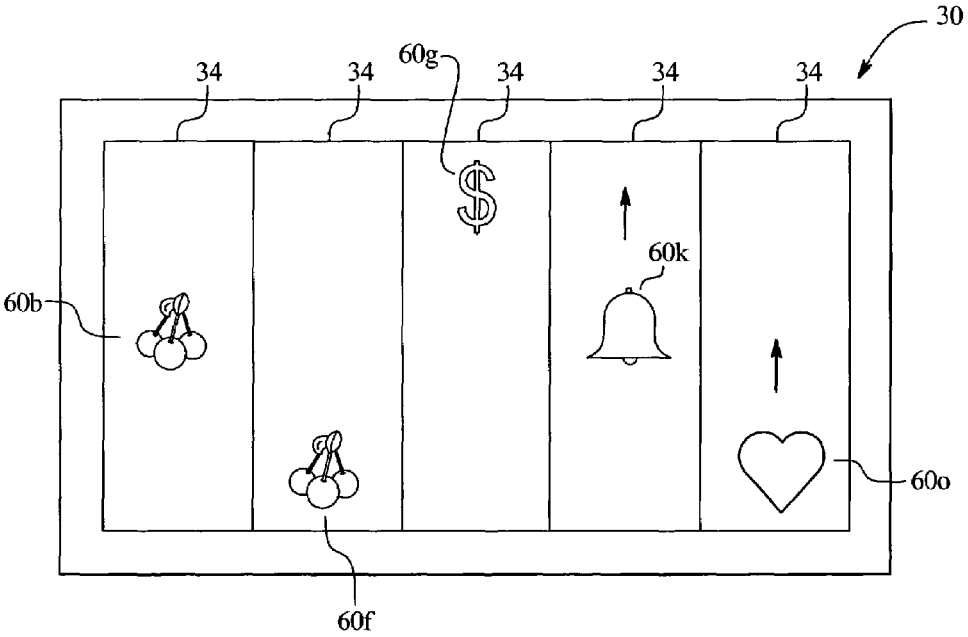
Figure 7:
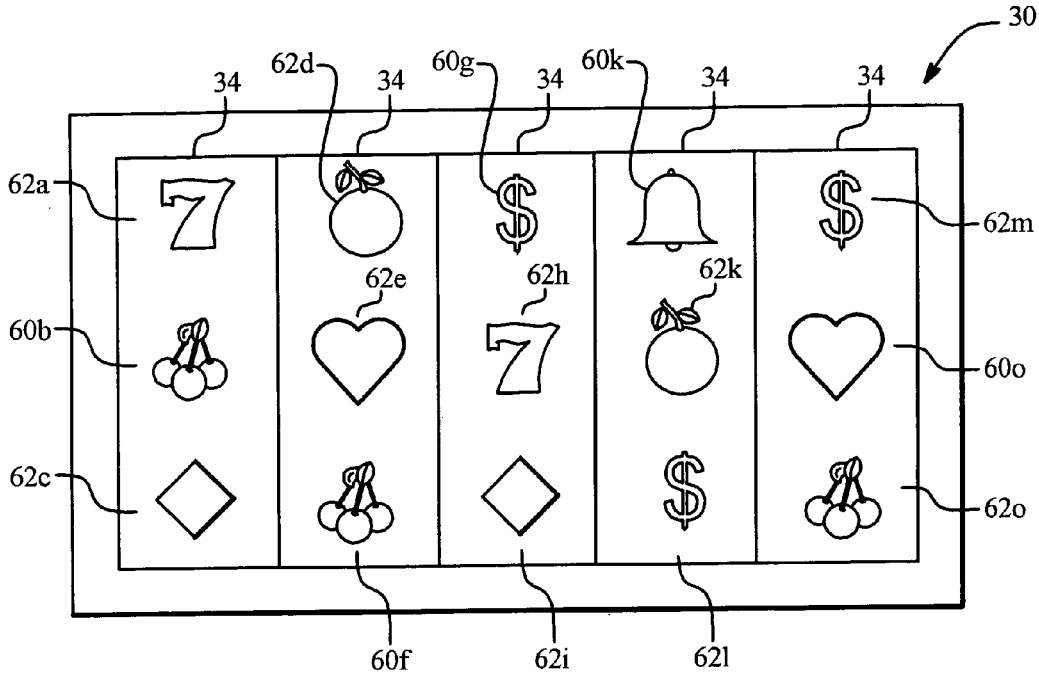
FIG. 7 is an enlarged front elevation view of one of the display devices of FIGS. 1A and 1B illustrating one embodiment of the present invention, wherein the virtual set of symbols is displayed.

In one embodiment of the invention, the processor 38 causes the display device to display a plurality of video gaming reels 34 as illustrated by FIG. 1. The video gaming reels 34 randomly generate and display a first set of symbols 60, which includes symbols 60*a*, 60*b*, 60*c*, 60*d*, 60*e*, 60*f*, 60*g*, 60*h*, 60*i*, 60*j*, 60*k*, 60*l*, 60*m*, 60*n* and 60*o* as illustrated by FIG. 4. The processor 38 also causes the video gaming reels to randomly generate a second set of symbols 62 as illustrated by FIG. 5. The random generation of the second set of symbols 62, which includes 62*a*, 62*b*, 62*c*, 62*d*, 62*e*, 62*f*, 62*g*, 62*h*, 62*i*, 62*j*, 62*k*, 62*l*, 62*m*, 62*n* and 62*o*, illustrated in FIG. 5 are not displayed to the player. The processor 38 determines whether any symbols randomly generated by each video gaming reel 34 in the first set of symbols 60 and the second set of symbols 62 match. In this illustration, the cherries 60*b* and 62*b* match on the first video gaming reel, the cherries 60*f* and 62*f* match on the second gaming reel, the dollar signs 60*g* and 62*g* match on the third gaming reel, the bells 60*k* and 62*j* match on the fourth gaming reel, and the hearts 60*o* and 62*n* match on the fifth gaming reel. Certain symbols may make additional matches such as the cherries 60*m* and 62*o* although in this illustrated embodiment, they are not employed. The processor causes the display device 30 to initially display the matching symbols 60*b*, 60*f*, 60*g*, 60*k* and 60*o* in their respective positions in the first set of symbols 60 as illustrated by FIG. 6*a*. The processor 38 then causes the display device 30 to display the matching symbols 60*k* and 60*o* moving into their positions in the second set of symbols. As illustrated by FIG. 6B, the bell 60*k* moves up into the third row from the second row, and the heart 60*o* moves up into the second row from the first row. The processor 38 then causes the display device 30 to display the second set of symbols 62 as illustrated by FIG. 7.

The video gaming reels 34 are stored in the memory 40 of the gaming device 10 and controlled by the processor 38 of the gaming device 10. The processor 38 also controls the display device 30 of the gaming device 10 and selectively causes the display device 30 to display the video gaming reels 34 and the spinning or the random generation of the reel symbols 60 and the set of symbols 60, 62 generated.

Figure 8:
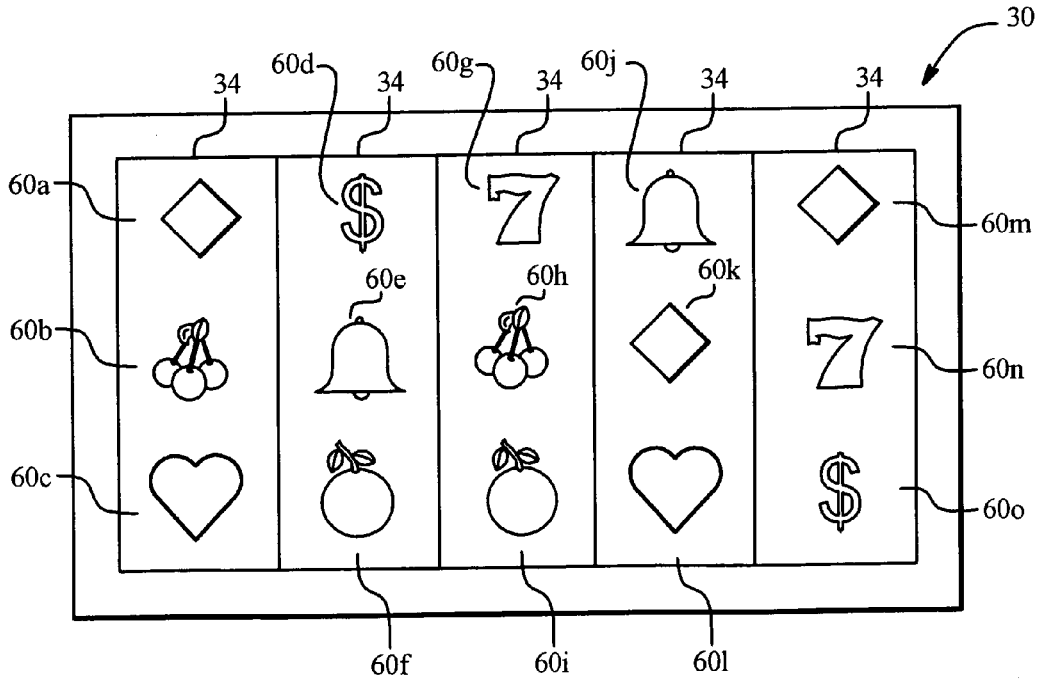
FIG. 8 is an enlarged front elevation view of one of the display devices of FIGS. 1A and 1B illustrating one embodiment of the present invention, wherein a set of symbols is initially displayed.
Figure 9:
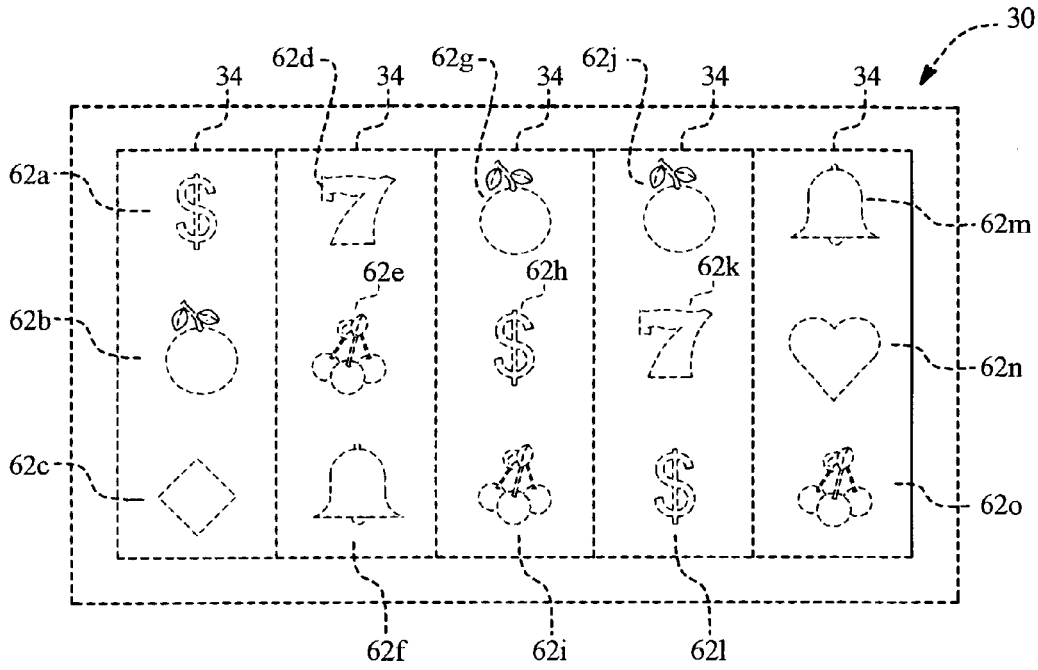
FIG. 9 is a view of one embodiment of the present invention, wherein a virtual set of symbols is generated by the gaming device.
Figure 10A:
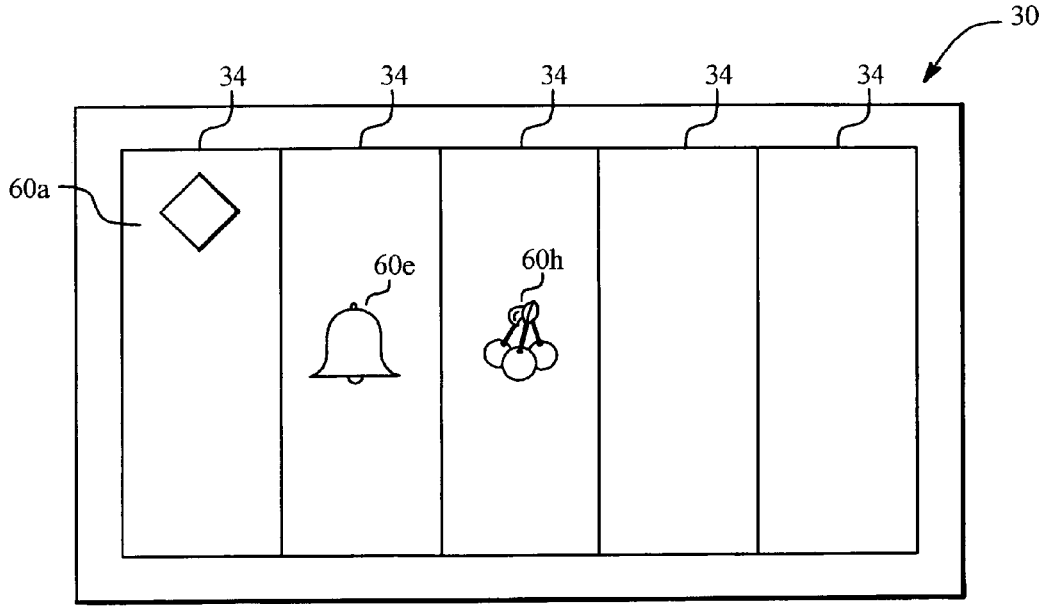
FIGS. 10A and 10B are enlarged front elevation views of the display devices of FIGS. 1A and 1B illustrating one embodiment of the present invention, wherein the matching symbols are displayed.
Figure 10B:
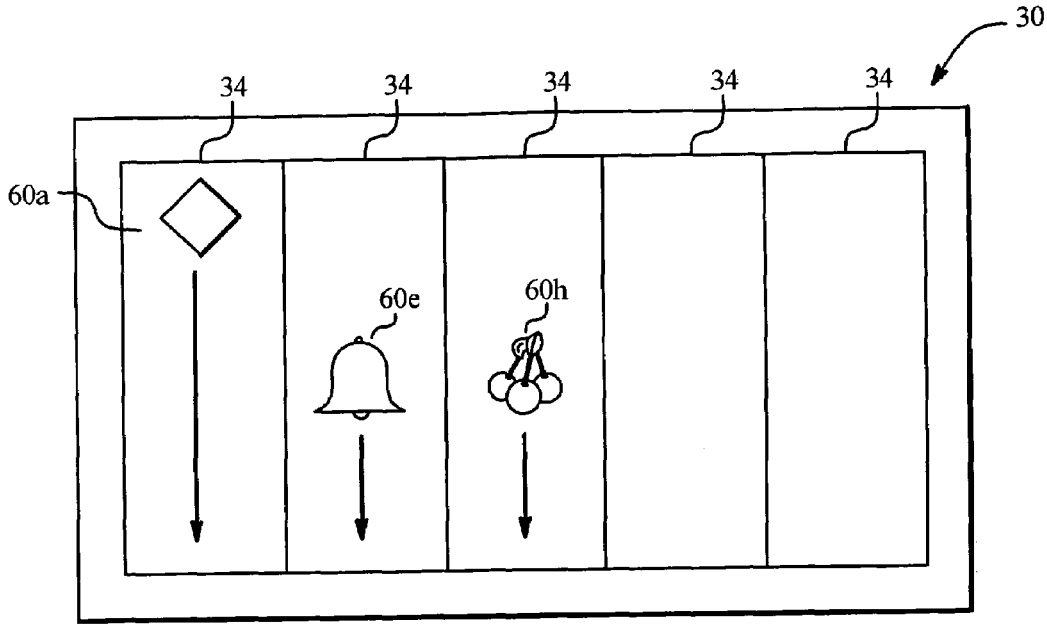
Figure 11:
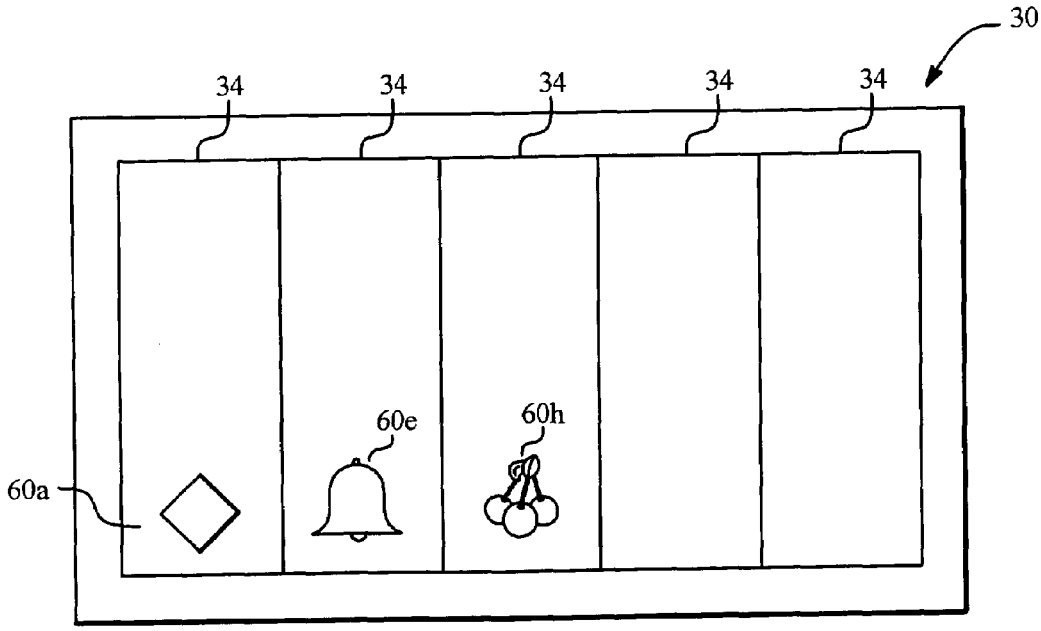
FIG. 11 is an enlarged front elevation view of the display devices of FIGS. 1A and 1B illustrating one embodiment of the present invention, wherein the matching symbols are displayed in horizontal alignment.
Figure 12:
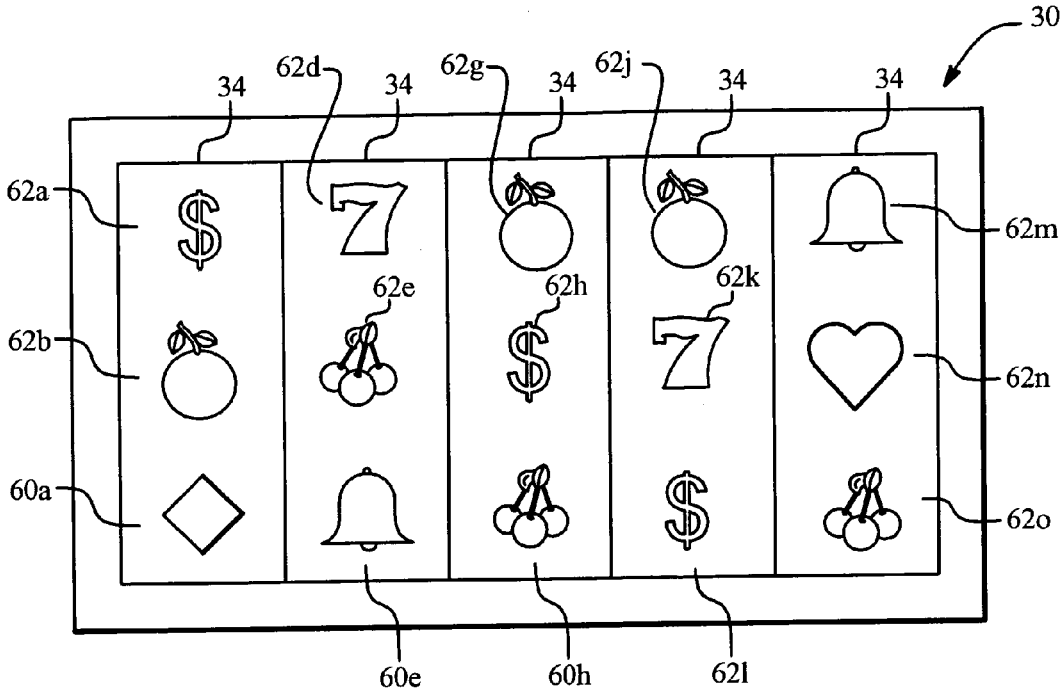
FIG. 12 is an enlarged front elevation view of the display devices of FIGS. 1A and 1B illustrating one embodiment of the present invention, wherein the virtual set of symbols is displayed.

In another embodiment of the present invention, the processor 38 causes the video gaming reels 34 to randomly generate and display a first set of symbols 60 as illustrated by FIG. 8. The processor 38 causes the video gaming reels 34 to generate a second set of symbols 62 as illustrated by FIG. 9. In this embodiment of the present invention, the processor 38 causes the display device 30 to initially display the matching symbols 60*a*, 60*e* and 60*h* for each gaming reel 34 in their positions in the first set of symbols as illustrated by FIG. 10*a*. The processor causes the display device 30 to display the matching symbols 60*a*, 60*e* and 60*h* moving into their positions in the second set of symbols as illustrated by FIG. 10*b*. The diamond 60*a* moves from the third row into the first row. The bell 60*e* moves from the second row into the first row. The cherries 60*h* move from the second row into the first row. The processor 38 causes the display device 30 to display the matching symbols 60*a*, 60*e* and 60*h* in their positions in the second set of symbols as illustrated by FIG. 11, and then causes the display of the second set of symbols 62 as illustrated by FIG. 12.

It should be understood that the matching symbols could be displayed in a variety of ways. Audio and video productions may be caused by the processor 38 as the display device 30 transitions from displaying the first set of symbols 60, to the matching symbols, to the second set of symbols 62. The matching symbols can be arranged or move in a predetermined manner or in a random fashion.

Figure 13:
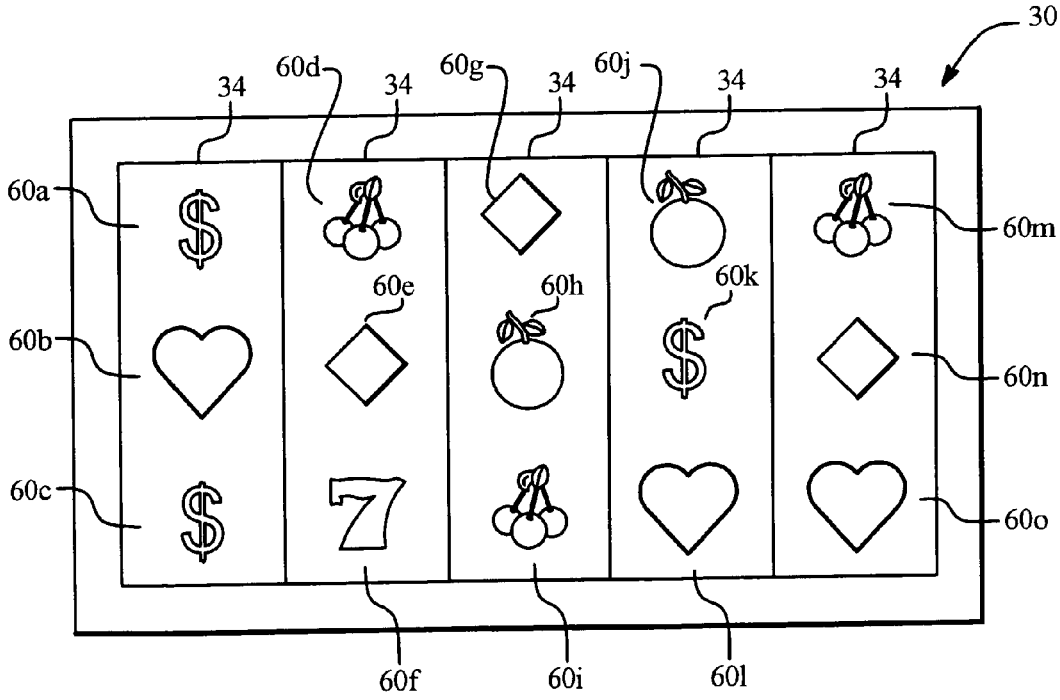
FIG. 13 is an enlarged front elevation view of the display devices of FIGS. 1A and 1B illustrating one embodiment of the present invention, wherein a set of symbols is initially displayed.
Figure 14:
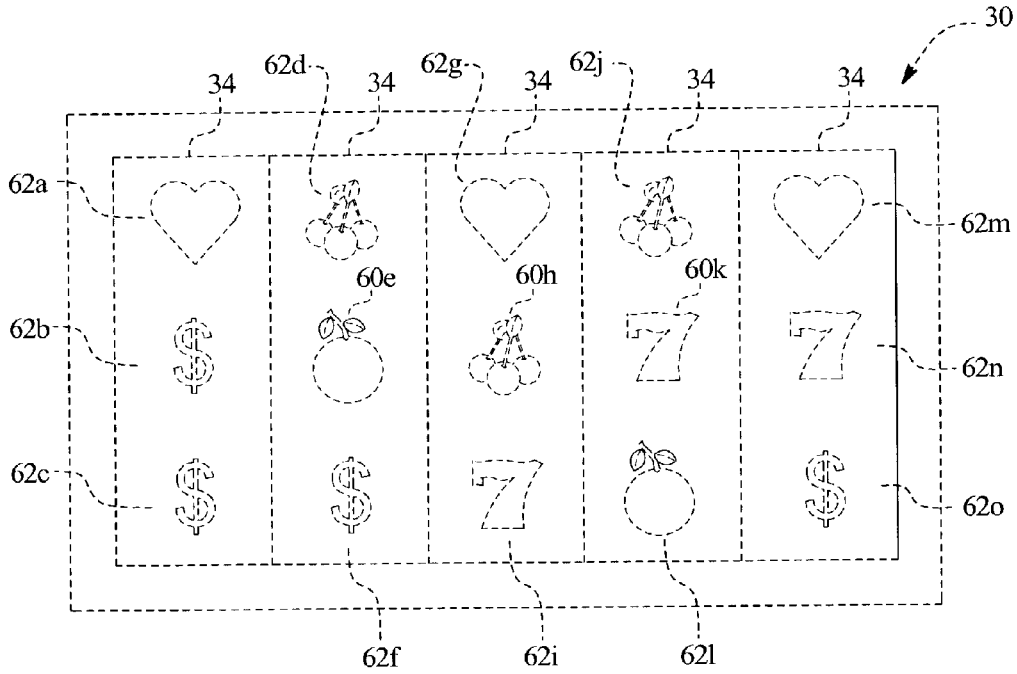
FIG. 14 is a view of one embodiment of the present invention, wherein the virtual set of symbols is generated by the gaming device.
Figure 15:
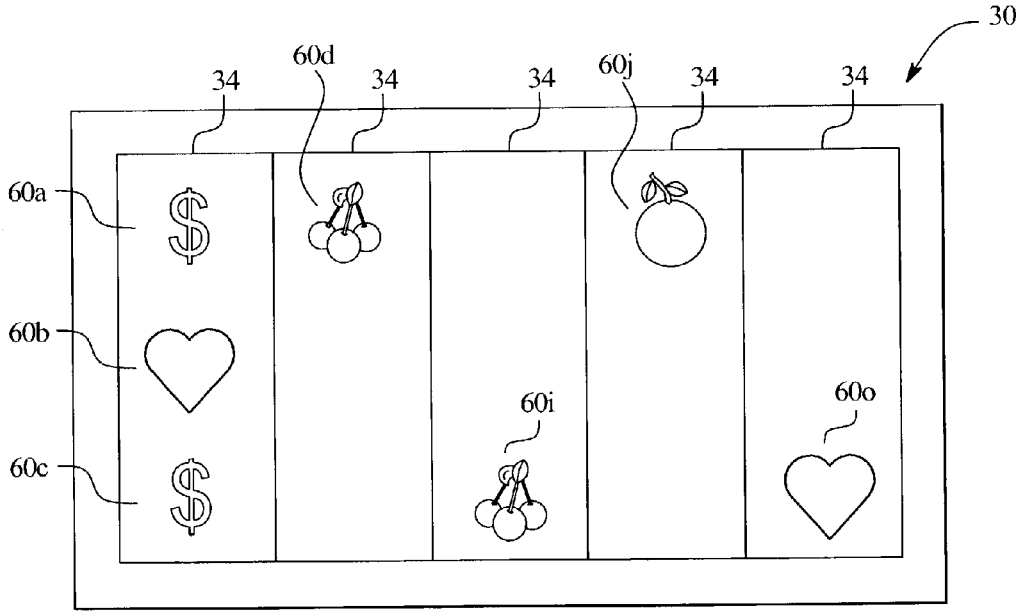
FIG. 15 is an enlarged front elevation view of one of the display devices of FIGS. 1A and 1B illustrating one embodiment of the present invention, wherein the matching symbols are displayed.
Figure 16:
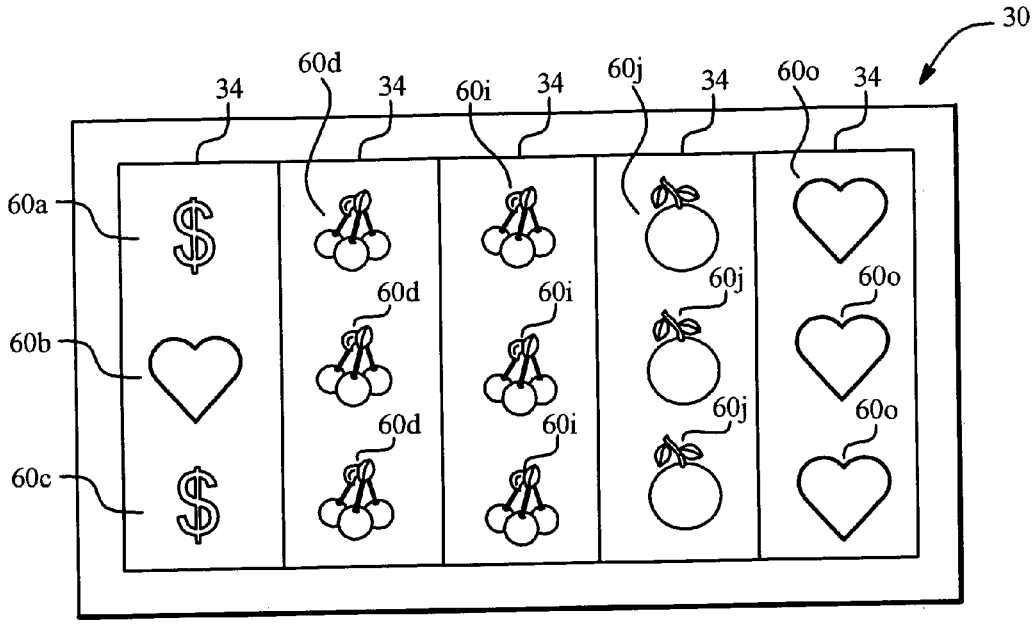
FIG. 16 is an enlarged front elevation view of one of the display devices of FIGS. 1A and 1B illustrating one embodiment of the present invention, wherein the matching symbols are displayed in a number of combinations.
Figure 17:
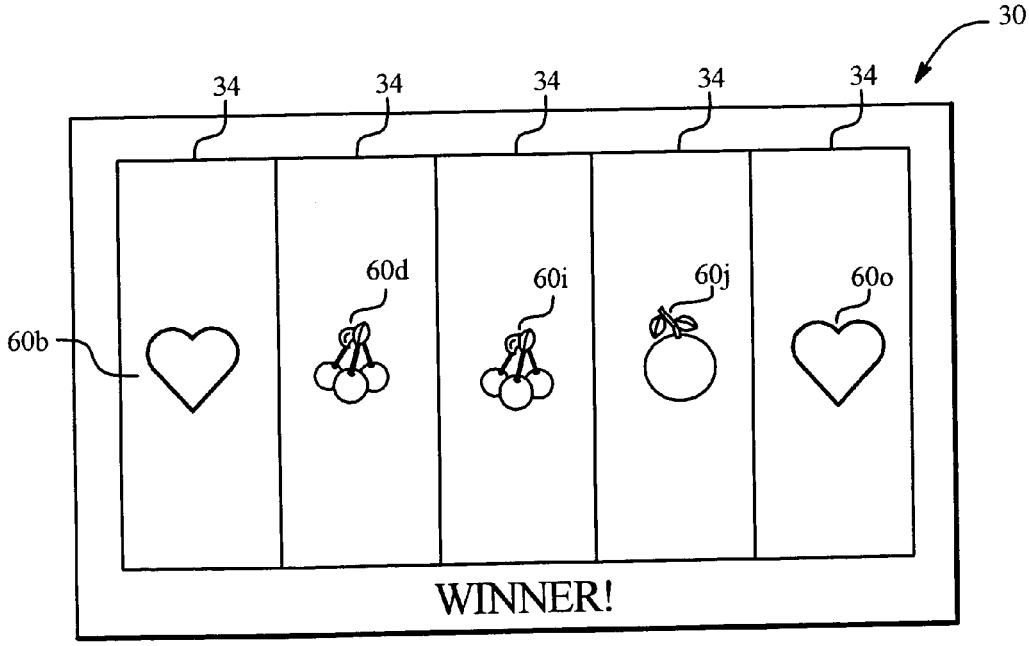
FIG. 17 is an enlarged front elevation view of one of the display devices of FIGS. 1A and 1B illustrating one embodiment of the present invention, wherein one of the combinations of matching symbols includes a winning combination of symbols.

In one embodiment of the present invention, the processor 38 causes the random generation of a first set of symbols 60 by the plurality of video gaming reels 34. The processor causes the display device 30 to display the first set of symbols 60 as illustrated by FIG. 13. The processor 38 causes the random generation of a second set of symbols 62 as illustrated by FIG. 14. The random generation of the second set of symbols 62 and the second set of symbols 62 is not displayed to the player. The processor 38 determines if there are any matching symbols and causes the display of the matching symbols 60*a*, 60*b*, 60*c*, 60*d*, 60*i*, 60*j* and 60*o* as illustrated by FIG. 15. There is a pair of dollar signs 60*a* and 60*c* and a heart 60*b* on the first video gaming reel, cherries 60*d* and 60*i* on the second and third video gaming reel, an orange 60*j* on the fourth video gaming reel, and a heart on the fifth video gaming reel 60*o*. The processor 38 causes the display device 30 to generate a plurality of combinations using the matching symbols 60*a*, 60*b*, 60*c*, 60*d*, 60*i*, 60*j* and 600 as illustrated by FIG. 16. The first row of symbols includes one dollar sign 60*a*, two cherries 60*d* and 60*i*, one orange 60*j* and one heart 60*j*. The second row of symbols includes one heart 60*b*, two cherries 60*d* and 60*i*, one orange 60*j* and one heart 60*j*. The third row of symbols includes one dollar sign 60*a*, two cherries 60*d* and 60*i*, one orange 60*j* and one heart 60*j*. In this embodiment, the one heart 60*b*, two cherries 60*d* and 60*i*, one orange 60*j* and one heart 60*j* is a winning combination of symbols as illustrated by FIG. 17. The processor 38 provides at least one award for the winning combination of symbols.

It should be understood that the processor 38 may provide awards for winning combinations of symbols included in the first set of symbols 60, in the second set of symbols 62 or in both. Each set of symbols may also be associated with the same or different winning combinations of symbols or awards. In one embodiment, the second set of symbols 62 may include higher or lower values associated with its related winning combinations of symbols than the values associated with the winning combinations related to the first set of symbols 60. The processor 38 may also provide higher values or larger awards for winning combinations of symbols which occur simultaneously in both the first set of symbols 60 and the second set of symbols 62.

It should be understood that the winning combination of symbols may include a predetermined combination occurring on one or more paylines. In one embodiment of the present invention, there are more paylines associated with the second set of symbols 62 than paylines associated with the first set of symbols 60.

Figure 18:
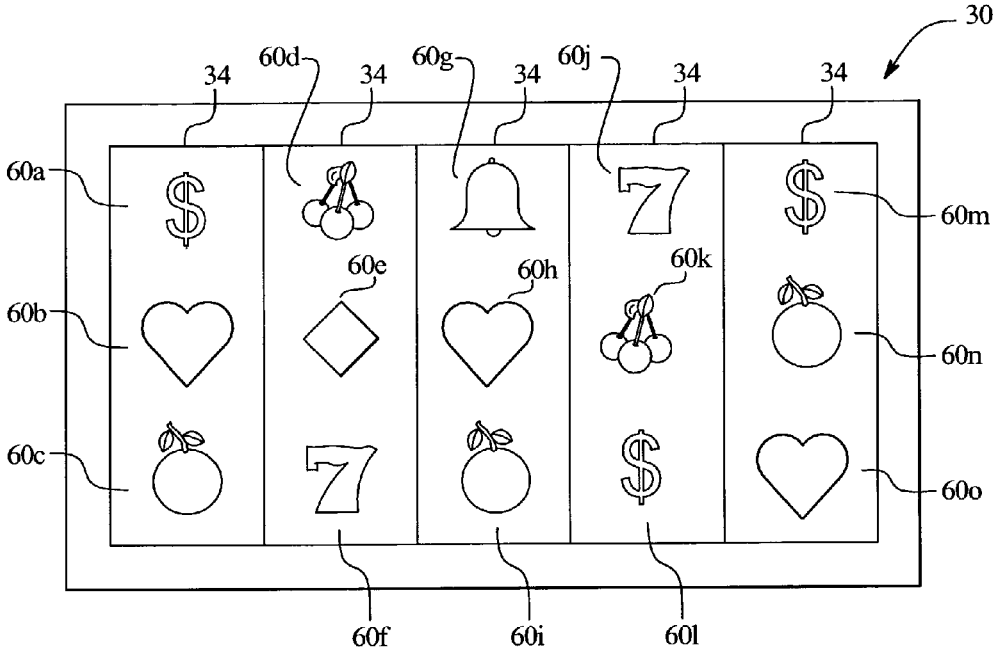
FIG. 18 is an enlarged front elevation view of one of the display devices of FIGS. 1A and 1B illustrating one embodiment of the present invention, wherein a set of symbols is initially displayed.
Figure 19:
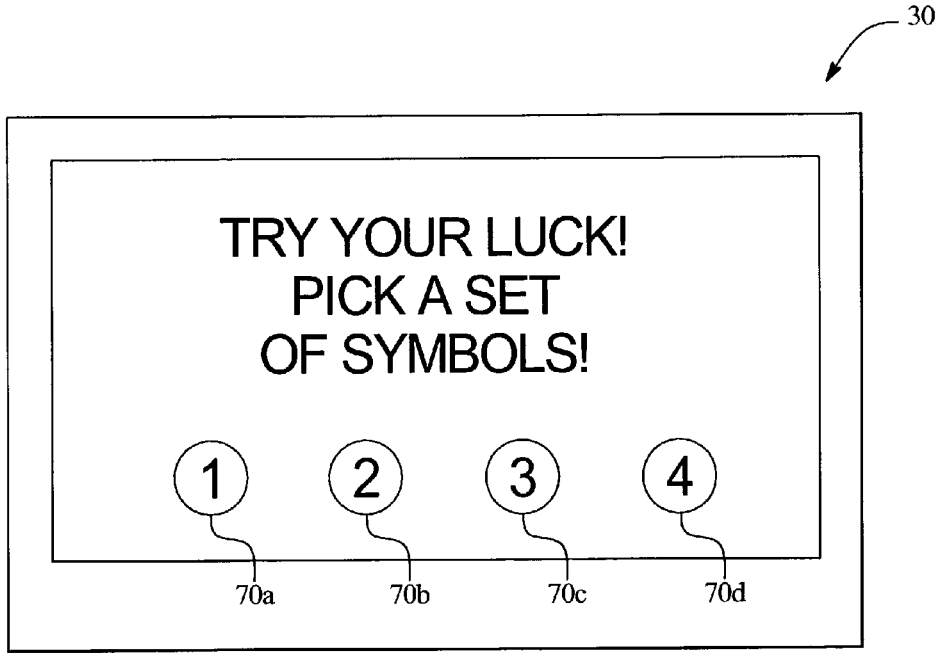
FIG. 19 is an enlarged front elevation view of one of the display devices of FIGS. 1A and 1B illustrating one embodiment of the present invention, wherein player is enabled to select one of a plurality of virtual sets of symbols.
Figure 20:
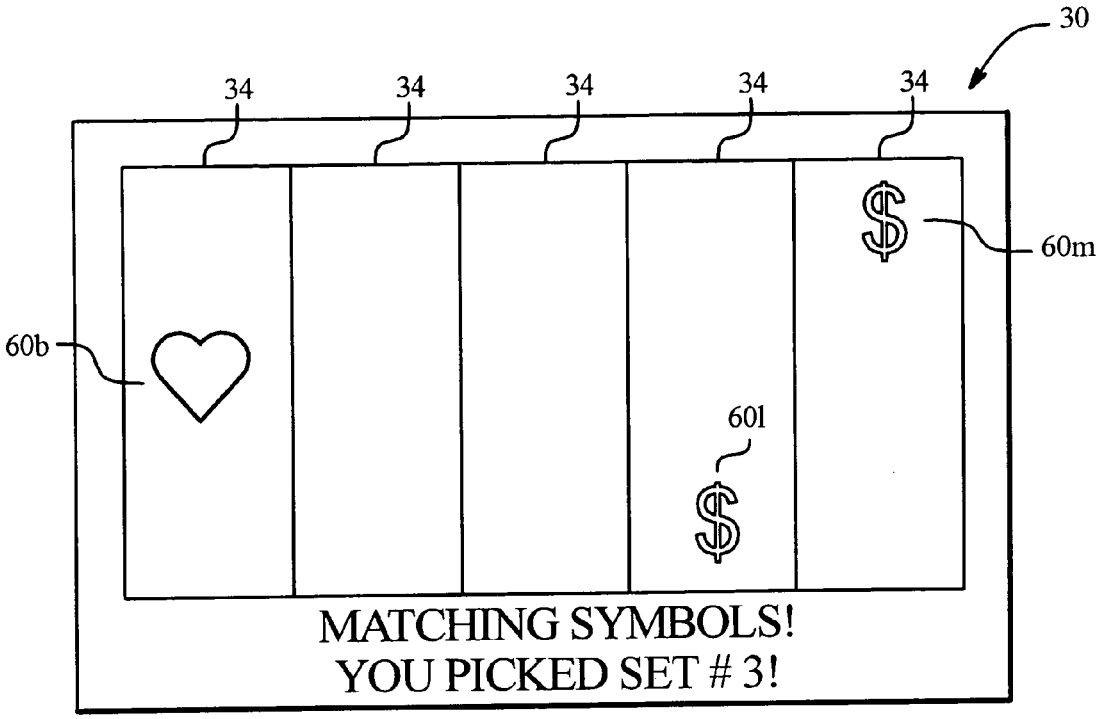
FIG. 20 is an enlarged front elevation view of one of the display devices of FIGS. 1A and 1B illustrating one embodiment of the present invention, wherein the symbols which match in the displayed set of symbols and the player selected virtual set of symbols are displayed.
Figure 21:
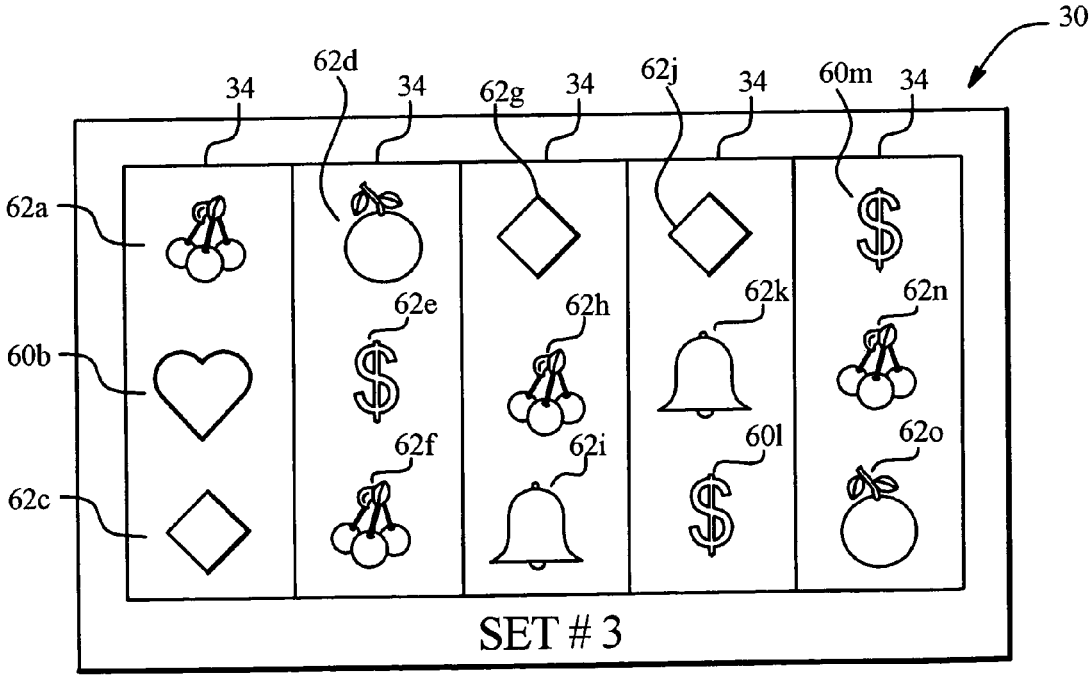
FIG. 21 is an enlarged front elevation view of one of the display devices of FIGS. 1A and 1B illustrating one embodiment of the present invention, wherein the player selected virtual set of symbols is displayed.
Figure 22:
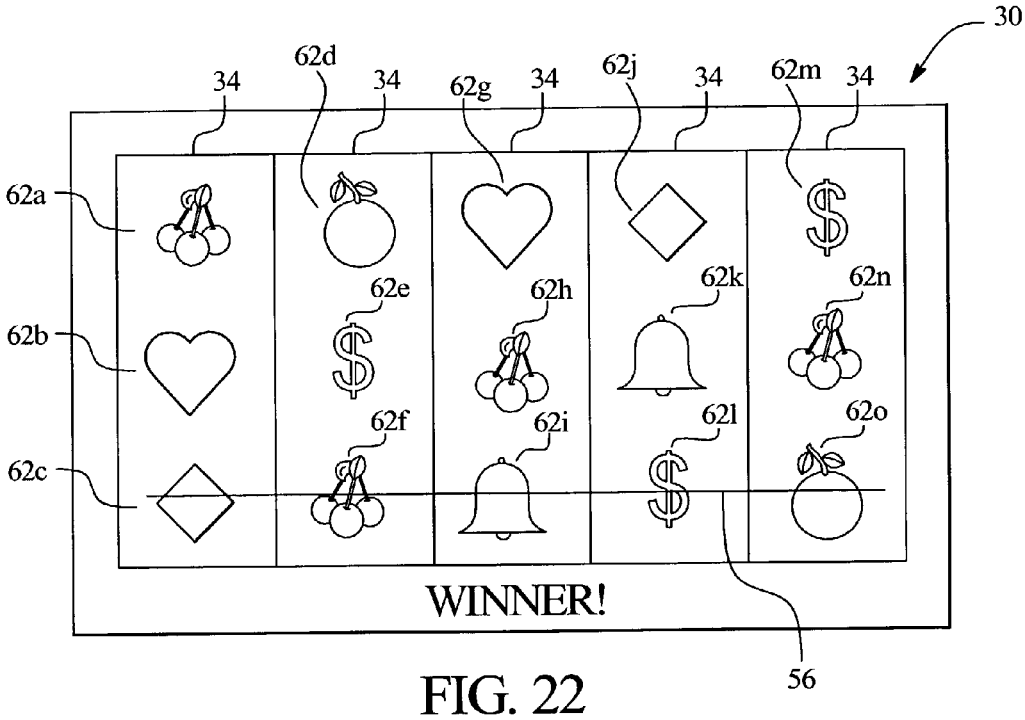
FIG. 22 is an enlarged front elevation view of one of the display devices of FIGS. 1A and 1B illustrating one embodiment of the present invention, wherein the player selected virtual set of symbols includes a winning combination of symbols.

In one embodiment of the present invention, the processor 38 causes the random generation of a first set of symbols 60 by a plurality of video gaming reels 34 and the display of the first set of symbols 60 as illustrated by FIG. 18. The processor 38 also causes the random generation of a plurality of virtual sets of symbols (not illustrated) which are not displayed to the player. Without displaying the symbols in the plurality of virtual sets of symbols, the processor 38 enables the player to choose one of the virtual sets of symbols, 70*a*, 70*b*, 70*c* and 70*d* as illustrated by FIG. 19. The player, in this embodiment, picks symbol 70*c* labeled number "3." The processor 38 determines if there are any matching symbols in the first set of symbols 60 and the selected virtual set of symbols 70*c*. The processor 38 causes the display device 30 to display the matching symbols 60*b*, 60*l* and 60*m*. The matching symbols 60*b*, 60*l* and 60*m* are the heart 60*b* on the first video gaming reel and dollar signs 60*l* and 60*m* on the fourth and fifth video gaming reels as illustrated by FIG. 20. The processor 38 causes the display of the selected virtual set of symbols 62 as illustrated by FIG. 21. In this embodiment, the combination of symbols 62*c*, 62*f*, 62*i*, 621 and 62*o* on payline 56 includes a winning combination of symbols, as illustrated by FIG. 22, and the player is provided with at least one award.

Figure 23:
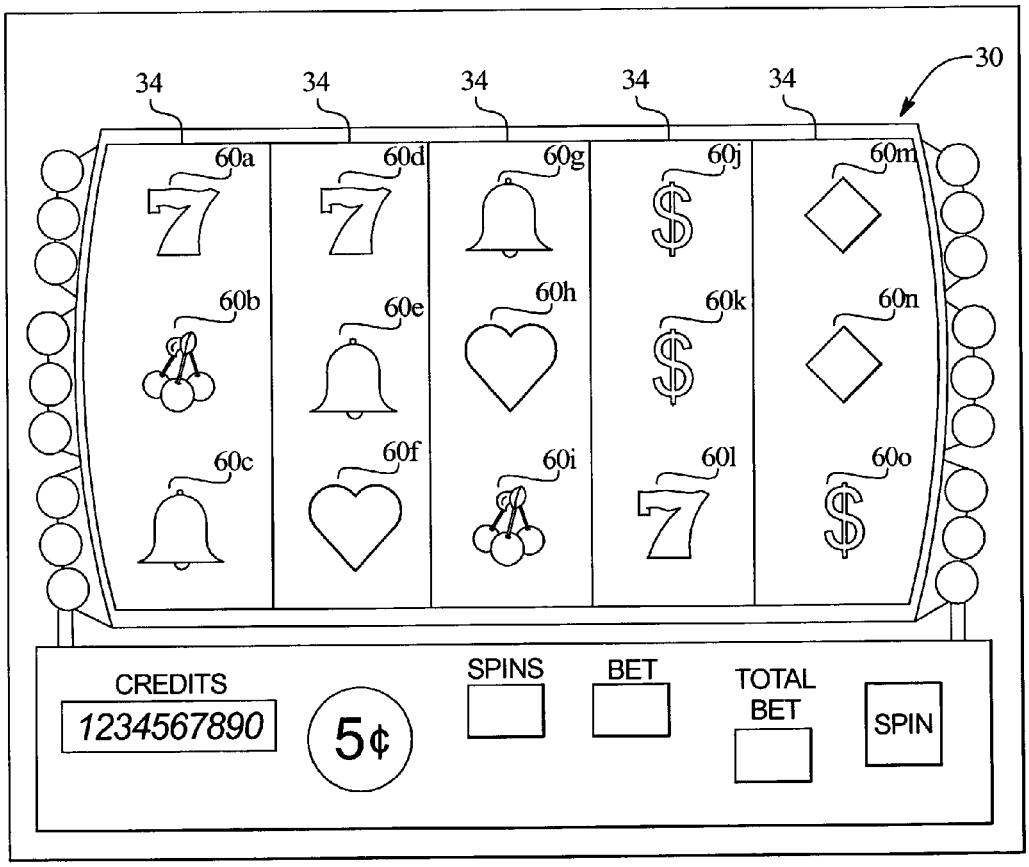
FIG. 23 is an enlarged front elevation view of one of the display devices of FIGS. 1A and 1B illustrating one embodiment of the present invention, wherein a first set of symbols is displayed.
Figure 24:
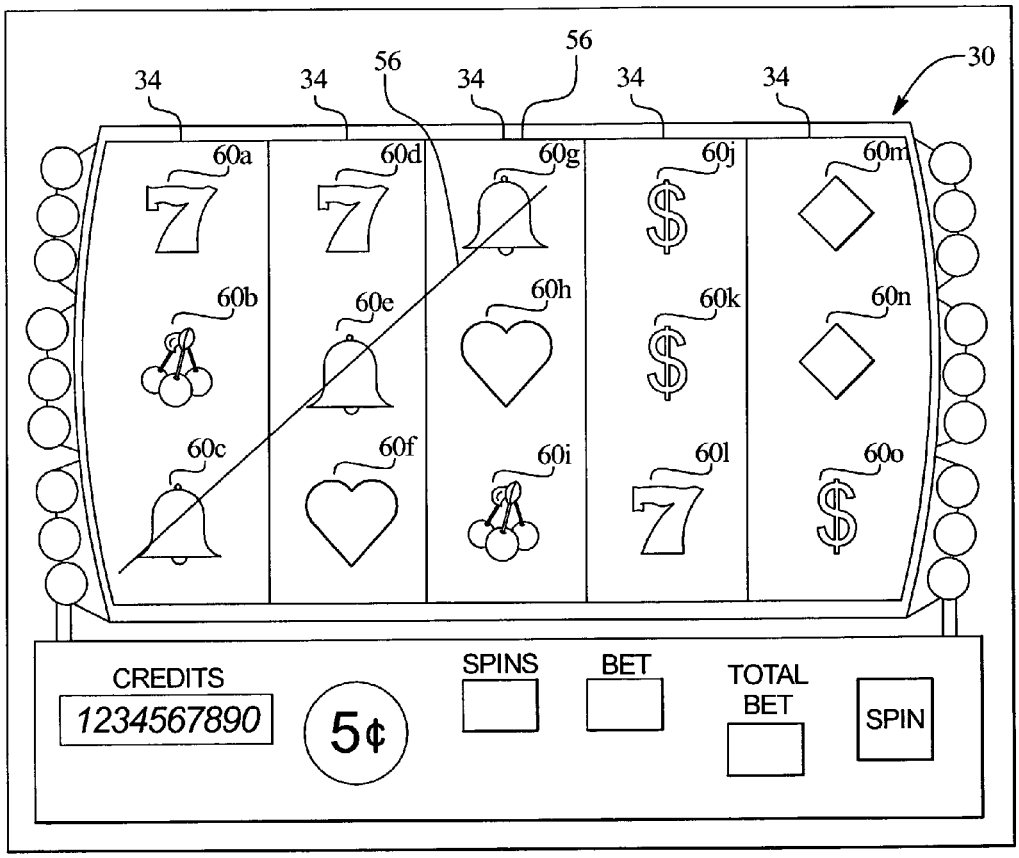
FIG. 24 is an enlarged front elevation view of one of the display devices of FIGS. 1A and 1B illustrating one embodiment of the present invention, wherein a winning combination of symbols is included on a payline in the first set of symbols.
Figure 25:
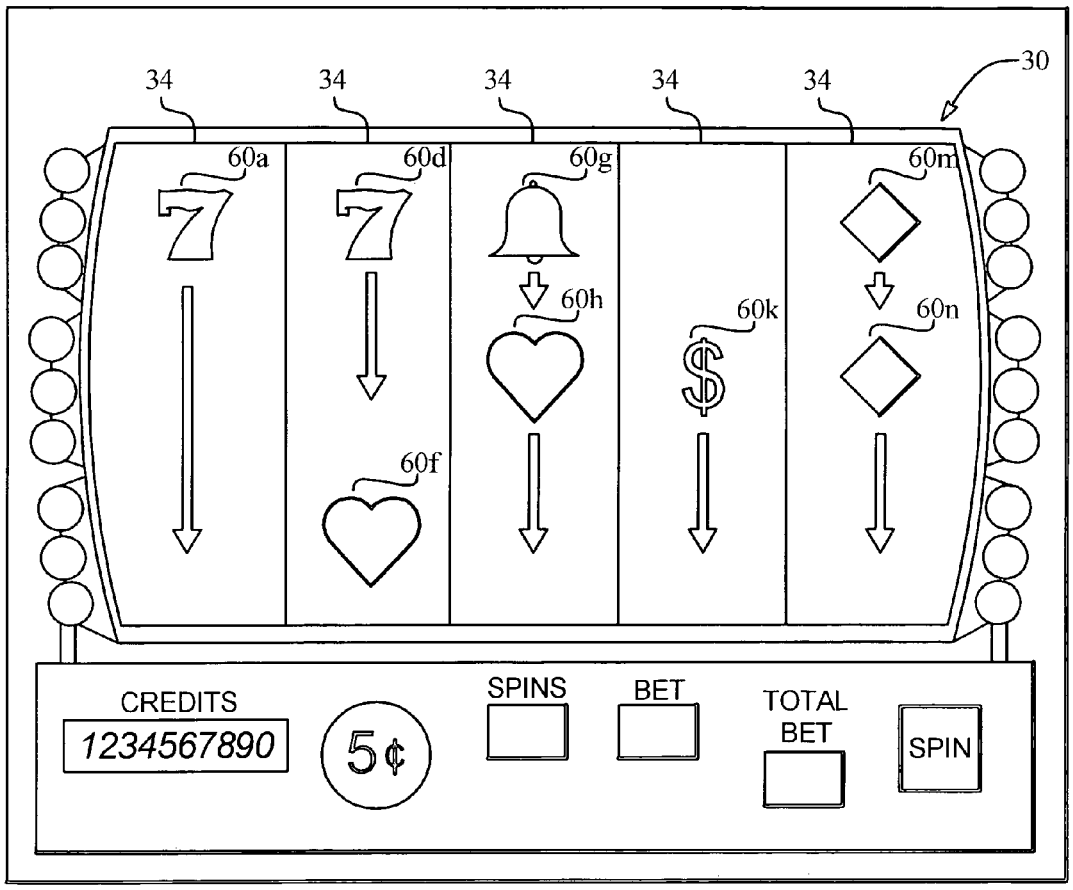
FIG. 25 is an enlarged front elevation view of one of the display devices of FIGS. 1A and 1B illustrating one embodiment of the present invention, wherein the matching symbols are displayed.
Figure 26:
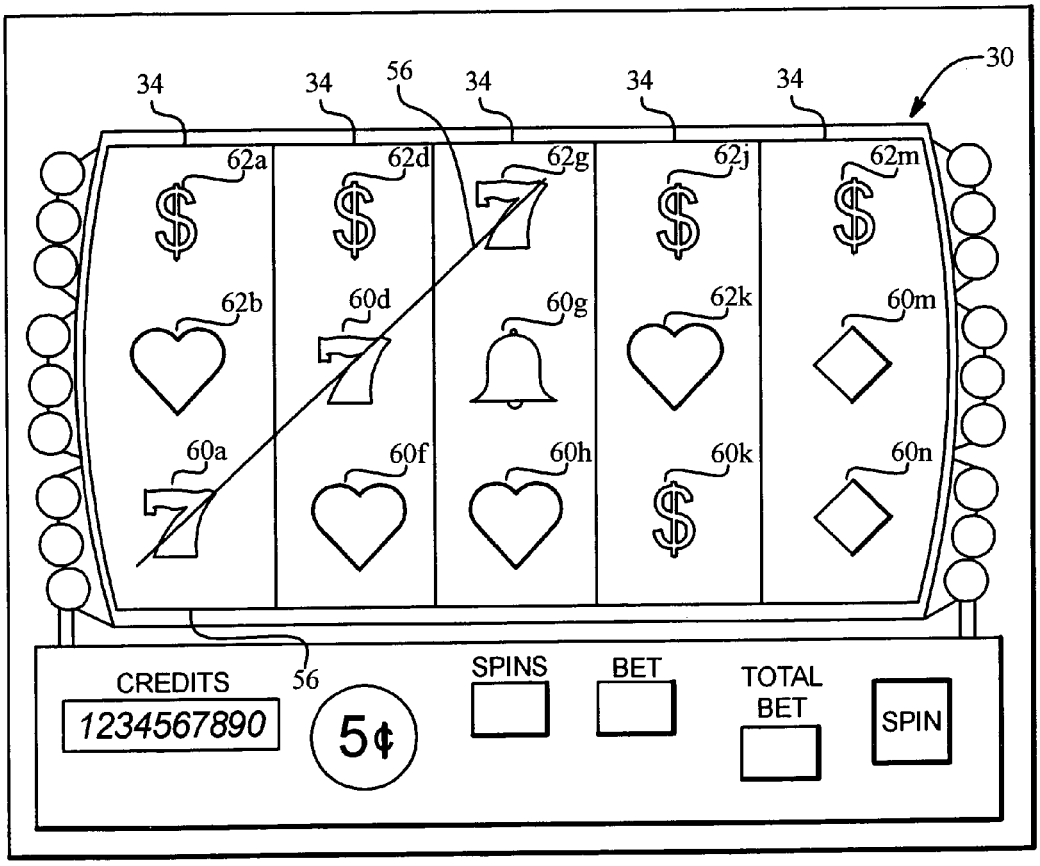
FIG. 26 is an enlarged front elevation view of one of the display devices of FIGS. 1A and 1B illustrating one embodiment of the present invention, wherein a second set of symbols is displayed including a winning combination of symbols on a payline.
Figure 27:
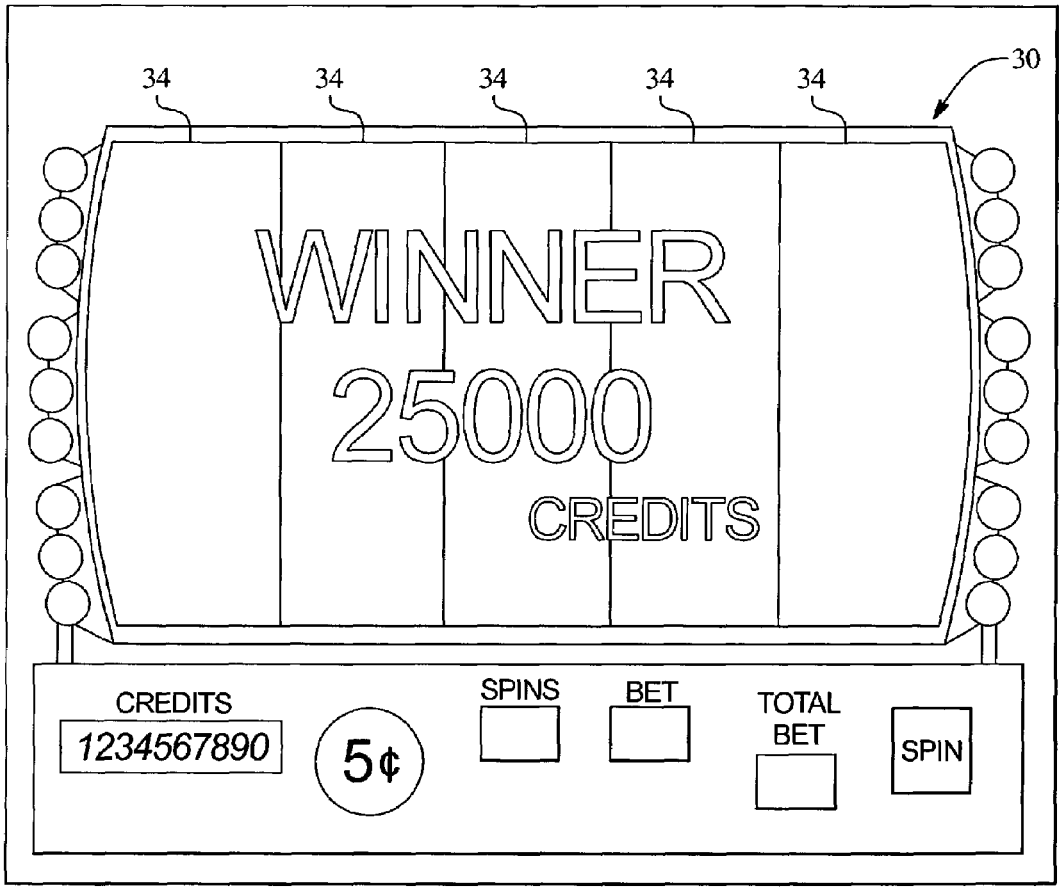
FIG. 27 is an enlarged front elevation view of one of the display devices of FIGS. 1A and 1B illustrating one embodiment of the present invention, wherein the player is provided with an award.

In one embodiment of the present invention, the processor 38 causes the random generation of a first set of symbols 60 and the display of the first set of symbols 60 as illustrated by FIG. 23. In this embodiment, the first set of symbols 60 includes a winning combination of symbols 60*c*, 60*e* and 60*g*. The processor 38 causes the display device 30 to superimpose the payline 56 with the winning combination of symbols 60*c*, 60*e* and 60*g* as illustrated by FIG. 24. The processor 38 determines if there are any matching symbols in the first set of symbols 60 and a second set of symbols (not shown). The processor 38 causes the display device 30 to display the matching symbols 60*a*, 60*d*, 60*f*, 60*g*, 60*h*, 60*k*, 60*m* and 60*n* as illustrated by FIG. 25. The processor 38 then causes a second display of the symbols including the display device 30 to shift the matching symbols to the lowest row on the display and to cause a second display of the symbols including the second set of symbols 62 as illustrated by FIG. 26. In this illustration a winning combination of symbols 60*a*, 60*d* and 62*g* occurs along a payline 56 in the second display of symbols 62 as illustrated by FIG. 26. The gaming device provides the player with an award as illustrated by FIG. 27.

In an alternative embodiment, the processor determines a random number of symbols to select from the first set of symbols and to use those symbols to form the second set of symbols. After the processor selects the symbols, it causes the other or non-selected symbols to be removed from the display. At that point, in one embodiment, the processor moves or shifts the matched symbols to selected or predetermined positions. In another embodiment, the processor keeps the matched symbols in the same position. The processor then randomly selects symbols which fill in at the locations of the unmatched symbols or the locations without the displayed matched symbols and then causes those symbols to be displayed.

It should be understood that the gaming device 10 can match the symbols in a variety of ways. The symbols can be matched to each corresponding position in a related set of symbols, or the symbols could be matched regardless of positions or reels.

It should be understood that the selection of one of the plurality of virtual sets of symbols may be either player or processor selected.

It should be understood that the gaming device may also include a plurality of sets of gaming reels which are initially displayed. In one embodiment of the present invention, the gaming device displays a plurality of sets of symbols. The gaming device determines if any symbols included in the displayed sets of symbols match any symbols included in one or more virtual sets of symbols. In another embodiment, one or more of the displayed sets of symbols are selected to be compared with one or more virtual sets of symbols.

It should be understood that there may be more than one pluralities of video gaming reels wherein a first plurality of video gaming reels randomly generate the first set of symbols and a second plurality of video gaming reels randomly generate the second or virtual set of symbols.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A method of operating a gaming device having a game operable upon a wager, for a play of said game, said method comprising:

(a) causing a random generation of a first set of symbols from a plurality of symbols and causing a display device to display said first set of symbols on a display including a plurality of rows and a plurality of columns;

(b) determining if the displayed first set of symbols includes a winning symbol combination;

(c) if the displayed first set of symbols includes the winning symbol combination, providing an award associated with the winning symbol combination to a player;

(d) separately from the random generation of the first set of symbols, causing a determination of at least one, but not all, of the symbols from the first set of generated symbols to maintain on the display, wherein said determination is independent of any displayed winning symbol combination and wherein in each of the rows, at least one of the displayed symbols is maintained and in each of the columns, at least one of the displayed symbols is maintained;

(e) removing any non-maintained symbols in the first set of generated symbols from the display;

(f) causing the display device to display a second set of symbols, for each of the non-maintained symbols in the first set of generated symbols, by:

(i) randomly generating one of the symbols from the plurality of symbols, and (ii) replacing on the display said non-maintained symbol with said randomly generated symbol;

(g) after the second set of symbols is displayed, determining if the displayed second set of symbols includes the winning symbol combination; and (h) if the displayed second set of symbols includes the winning symbol combination, providing the award associated with the winning symbol combination to the player.

2. The method of claim 1, which includes causing a determination of, for at least one of the rows, a plurality of but not all of the symbols from the first set of generated symbols to maintain on the display.

3. The method of claim 1, which includes causing a determination of, for at least one of the columns, a plurality of but not all of the symbols from the first set of generated symbols to maintain on the display.

4. The method of claim 1, which includes the step of operating the gaming device through a data network.

5. The method of claim 4, wherein the data network is an internet.

6. The method of claim 1, wherein computer instructions for implementing steps (a) to (d) are stored in a memory device.

7. A method of operating a gaming device having a game operable upon a wager, for a play of said game, said method comprising:

(a) causing a random generation of a first set of symbols from a plurality of symbols and causing a display device to display said first set of symbols on a display in a plurality of columns;

(b) determining if the displayed first set of symbols includes a winning symbol combination;

(c) if the displayed first set of symbols includes the winning symbol combination, providing an award associated with the winning symbol combination to a player;

(d) separately from the random generation of the first set of symbols, causing a determination of at least one, but not all, of the symbols from the first set of generated symbols to maintain on the display, wherein said determination is independent of any displayed winning symbol combination and wherein in each of the columns, at least one of the displayed symbols is maintained and in at least one of the columns, each of the displayed symbols are maintained;

(e) removing any non-maintained symbols in the first set of generated symbols from the display;

(f) causing the display device to display a second set of symbols, for each of the non-maintained symbols in the first set of generated symbols, by:

(i) randomly generating one of the symbols from the plurality of symbols, and (ii) replacing on the display said non-maintained symbol with said randomly generated symbol;

(g) after the second set of symbols is displayed, determining if the displayed second set of symbols includes the winning symbol combination; and (h) if the displayed second set of symbols includes the winning symbol combination, providing the award associated with the winning symbol combination to the player.

8. The method of claim 7, which includes causing a determination of, for at least one of the columns, a plurality of but not all of the symbols from the first set of generated symbols to maintain on the display.

9. The method of claim 7, which includes causing a determination of, for each of the columns, a plurality of the displayed symbols from the first set of generated symbols to maintain on the display.

10. The method of claim 7, which includes the step of operating the gaming device through a data network.

11. The method of claim 10, wherein the data network is an internet.

12. The method of claim 7, wherein computer instructions for implementing steps (a) to (d) are stored in a memory device.

13. A method of operating a gaming device having a game operable upon a wager, for a play of said game, said method comprising:

(a) causing a random generation of a first set of symbols from a plurality of symbols and causing a display device to display said first set of symbols on a display in a plurality of rows;

(b) determining if the displayed first set of symbols includes a winning symbol combination;

(c) if the displayed first set of symbols includes the winning symbol combination, providing an award associated with the winning symbol combination to a player;

(d) separately from the random generation of the first set of symbols, causing a determination of at least one, but not all, of the symbols from the first set of generated symbols to maintain on the display, wherein said determination is independent of any displayed winning symbol combination and wherein in each of the rows, at least one of the displayed symbols is maintained and in at least one of the rows, all of the displayed symbols are maintained;

(e) removing any non-maintained symbols in the first set of generated symbols from the display;

(f) causing the display device to display a second set of symbols, for each of the non-maintained symbols in the first set of generated symbols, by:

(i) randomly generating one of the symbols from the plurality of symbols, and (ii) replacing on the display said non-maintained symbol with said randomly generated symbol;

(g) after the second set of symbols is displayed, determining if the displayed second set of symbols includes the winning symbol combination; and (h) if the displayed second set of symbols includes the winning symbol combination, providing the award associated with the winning symbol combination to the player.

14. The method of claim 13, which includes causing a determination of, for at least one of the rows, a plurality of but not all of the symbols from the first set of generated symbols to maintain on the display.

15. The method of claim 13, which includes causing a determination of, for each of the rows, a plurality of the displayed symbols from the first set of generated symbols to maintain on the display.

16. The method of claim 13, which includes the step of operating the gaming device through a data network.

17. The method of claim 13, wherein the data network is an internet.

18. The method of claim 13, wherein computer instructions for implementing steps (a) to (d) are stored in a memory device.

* * * * *

UNITED STATES PATENT AND TRADEMARK OFFICE

CERTIFICATE OF CORRECTION

PATENT NO. : 7,666,085 B2
APPLICATION NO. : 10/241128
DATED : February 23, 2010
INVENTOR(S) : Vorias et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1528 days.

Signed and Sealed this

Seventh Day of December, 2010

David J. Kappos

David J. Kappos
*Director of the United States Patent and Trademark Office*